US008199081B2

(12) United States Patent
Minami

(10) Patent No.: US 8,199,081 B2
(45) Date of Patent: Jun. 12, 2012

(54) DISPLAY APPARATUS, DISPLAY-APPARATUS DRIVING METHOD AND ELECTRONIC INSTRUMENT

(75) Inventor: Tetsuo Minami, Tokyo (JP)

(73) Assignee: Sony Corporation, Tokyo (JP)

( * ) Notice: Subject to any disclaimer, the term of this patent is extended or adjusted under 35 U.S.C. 154(b) by 911 days.

(21) Appl. No.: 12/285,726

(22) Filed: Oct. 14, 2008

(65) Prior Publication Data

US 2009/0122046 A1 May 14, 2009

(30) Foreign Application Priority Data

Nov. 14, 2007 (JP) ..... 2007-295383

(51) Int. Cl.
*G09G 3/28* (2006.01)
*G09G 3/38* (2006.01)

(52) U.S. Cl. ..... 345/77; 345/76; 345/211; 345/212; 345/213

(58) Field of Classification Search ..... 345/77, 345/211
See application file for complete search history.

(56) References Cited

U.S. PATENT DOCUMENTS

| | | | | |
|---|---|---|---|---|
| 7,986,285 | B2 * | 7/2011 | Iida et al. | 345/76 |
| 2008/0030436 | A1 * | 2/2008 | Iida et al. | 345/77 |
| 2008/0042939 | A1 * | 2/2008 | Yamashita et al. | 345/76 |

FOREIGN PATENT DOCUMENTS

JP 2006-133542 5/2006

* cited by examiner

*Primary Examiner* — Sumati Lefkowitz
*Assistant Examiner* — Andrew Yeretsky
(74) *Attorney, Agent, or Firm* — Rader Fishman & Grauer, PLLC

(57) ABSTRACT

Disclosed herein is a display apparatus including: a pixel array section including pixel circuits laid out to form a matrix as pixel circuits each having an electro optical device, a signal writing transistor, a device driving transistor, and a storage capacitor; a power-supply scan circuit; a signal outputting circuit; and a write scan circuit.

9 Claims, 18 Drawing Sheets

THRESHOLD-VOLTAGE CORRECTION PERIOD
THRESHOLD-VOLTAGE CORRECTION PERIOD
SIGNAL WRITE & MOBILITY CORRECTION PERIOD

Vh
Vl
Vh
Vl

THRESHOLD-VOLTAGE CORRECTION PERIOD
THRESHOLD-VOLTAGE CORRECTION PERIOD
SIGNAL WRITE & MOBILITY CORRECTION PERIOD

Vl
Vh
Vh
Vl

DISPLAY APPARATUS, DISPLAY-APPARATUS DRIVING METHOD AND ELECTRONIC INSTRUMENT

CROSS REFERENCES TO RELATED APPLICATIONS

The present invention contains subject matter related to Japanese Patent Application JP 2007-295383 filed in the Japan Patent Office on Nov. 14, 2007, the entire contents of which being incorporated herein by reference.

BACKGROUND OF THE INVENTION

1. Field of the Invention

In general, the present invention relates to a display apparatus, a display-apparatus driving method and an electronic instrument. In particular, the present invention relates to a display apparatus having the type of a flat panel having pixels laid out two-dimensionally to form a matrix as pixels each including an electro optical device and relates to a method for driving the display apparatus as well as an electronic instrument employing the display apparatus.

2. Description of the Related Art

In recent years, in the field of display apparatus for displaying images, a display apparatus having the type of a flat panel having pixels laid out two-dimensionally to form a matrix as pixels each including a light emitting device has been becoming popular at a high pace. In the following description, a pixel is also referred to as a pixel circuit. The light emitting device employed in each pixel circuit of a flat-panel display apparatus as a light emitting device of the so-called current-driven type in which the luminance of light emitted by the light emitting device varies in accordance with the magnitude of a current flowing through the device. An example of a flat-panel display apparatus employing light emitting devices of the so-called current-driven type is an organic EL (Electro Luminescence) display apparatus. An organic EL display apparatus employs organic EL devices each making use of a phenomenon in which light is generated when an electric field is applied to an organic thin film of the organic EL device.

An organic EL display apparatus has the following characteristics. An organic EL device has a low power consumption since the device is capable of operating even if the device is driven by a low applied voltage not exceeding 10 V. In addition, since an organic EL device is a device generating light by itself, an image generated by the light exhibits a high degree of recognizability in comparison with a liquid-crystal display apparatus displaying an image in accordance with an operation to control the luminance of light generated by a light source known as a backlight for a liquid crystal employed in every pixel circuit. On top of that, since an organic EL display apparatus does not require an illumination member such as a backlight, the apparatus can be made light and thin with ease. Moreover, since an organic EL device has a very short response time of about few microseconds, no residual image is generated at a display time of a moving image.

Much like a liquid-crystal display apparatus, the organic EL display apparatus can adopt either a passive or active matrix method as its driving method. However, even though a display apparatus adopting the passive matrix method has a simple structure, the light emission period of the electro optical device decreases as the number of scan lines (that is, the number of pixel circuits) increases. Thus, the organic EL display apparatus raises a problem of difficulties in implementing a large-size and high-definition model.

For the reason described above, display apparatus adopting the active matrix method are developed extensively in recent years. In accordance with the active matrix method, an active device for controlling a current flowing through an electro optical device is provided in the same pixel circuit as the electro optical device. An example of the active device is a field effect transistor of the insulated-gate type. The field effect transistor of the insulated-gate type is generally a TFT (Thin Film Transistor). In a display apparatus adopting the active matrix method, each electro optical device is capable of sustaining the state of emitting light throughout the period of one frame. It is thus easy to implement a large-size and high-definition display apparatus adopting the active matrix method.

By the way, an I-V characteristic exhibited by the organic EL device as a characteristic representing a relation between a voltage applied to the device and a current flowing to the device as a result of applying the voltage thereto generally deteriorates with the lapse of time as is commonly known. The deterioration with the lapse of time is referred to as time degradation. In a pixel circuit employing a TFT of the N-channel type as a device driving transistor for flowing a current to the organic EL device included in the pixel circuit, the source electrode of the TFT is connected to the organic EL device. Thus, due to the time degradation of the I-V characteristic exhibited by the organic EL device, a voltage Vgs applied between the gate and source electrodes of the device driving transistor changes and, as a result, the luminance of light emitted by the organic EL device also changes as well.

What is described above is explained more concretely as follows. An electric potential appearing on the source electrode of a device driving transistor is determined by the operating point of the device driving transistor and the organic EL device. Due to the time degradation, the operating point of the device driving transistor and the organic EL device changes undesirably. Thus, even if the voltage applied to the gate electrode of the device driving transistor remains unchanged, the electric potential appearing on the source electrode of a device driving transistor changes. That is to say, the voltage Vgs applied between the gate and source electrodes of the device driving transistor changes. Thus, a current flowing through the device driving transistor changes. As a result, a current flowing through the organic EL device also changes as well so that the luminance of light emitted by the organic EL device varies.

In addition, in a pixel circuit employing a poly-silicon TFT as the device driving transistor, besides the time degradation of the organic EL device, the threshold voltage Vth of the device driving transistor and the mobility μ of a semiconductor thin film forming a channel of the device driving transistor included in the device driving transistor also change due to the time degradation. In the following description, the mobility μ of a semiconductor thin film included in the device driving transistor is referred to simply as the mobility μ of the device driving transistor. In addition, the characteristics of the threshold voltage Vth and the mobility μ also change from pixel to pixel due to variations in manufacturing process. That is to say, there are transistor variations among individual pixel characteristics.

If the threshold voltage Vth and mobility μ of the device driving transistor change from pixel to pixel, the current flowing through the device driving transistor also changes from pixel to pixel as well. Thus, even if the voltage applied to the gate electrode of the device driving transistor remains unchanged, the luminance of light emitted by the organic EL device also varies from pixel to pixel as well. As a result, screen uniformity is lost.

In order to sustain the luminance of light emitted by the organic EL device at a constant value not affected by variations of the I-V characteristic of the organic EL device, variations of the threshold voltage Vth and variations of the mobility μ of the device driving transistor for a constant voltage applied to the gate electrode of the device driving transistor even if the characteristic of the organic EL device, the threshold voltage Vth and the mobility μ change due to the time degradation, as disclosed in documents such as Japanese Patent Laid-open No. 2006-133542 (hereinafter referred to as Patent Document 1), it is thus necessary to provide a configuration including a compensation function for correcting the luminance of light emitted by the organic EL device for variations of the I-V characteristic of the organic EL device, a compensation function for correcting the luminance of light emitted by the organic EL device for variations of the threshold voltage Vth of the device driving transistor and a compensation function for correcting the luminance of light emitted by the organic EL device for variations of the mobility μ of the device driving transistor. In the following description, the process of correcting the luminance of light emitted by the organic EL device for variations of the threshold voltage Vth of the device driving transistor is referred to as a threshold-voltage correction process whereas the process of correcting the luminance of light emitted by the organic EL device for variations of the mobility μ of the device driving transistor is referred to as a mobility correction process.

By providing each pixel circuit with a compensation function for correcting the luminance of light emitted by the organic EL device for variations of the I-V characteristic of the organic EL device, a compensation function for correcting the luminance of light emitted by the organic EL device for variations of the threshold voltage Vth of the device driving transistor and a compensation function for correcting the luminance of light emitted by the organic EL device for variations of the mobility μ of the device driving transistor as described above, it is possible to sustain the luminance of light emitted by the organic EL device at a constant value not affected by variations of the characteristic of the organic EL device, variations of the threshold voltage Vth and variations of the mobility μ of the device driving transistor for a constant voltage applied to the gate electrode of the device driving transistor even if the characteristic of the organic EL device, the threshold voltage Vth and the mobility μ change due to the time degradation. Thus, the display quality of the organic EL display apparatus can be improved.

SUMMARY OF THE INVENTION

In accordance with the related-art technology disclosed in Patent Document 1, each of the pixel circuits is provided with a function for correcting the luminance of light emitted by the organic EL device for variations of the characteristic of the organic EL device as well as a function for correcting the luminance of light emitted by the organic EL device for variations of the threshold voltage Vth and mobility μ of the device driving transistor. Thus, even if the I-V characteristic of the organic EL device or the threshold voltage Vth and mobility μ of the device driving transistor deteriorate in a time degradation process, the luminance of light emitted by the organic EL device can be sustained at a constant value not affected by the deteriorations of the I-V characteristic, the threshold voltage Vth and/or the mobility μ. On the other hand, the number of components composing the pixel circuit provided with such functions is large, hindering efforts to reduce the size of the pixel circuit and, hence, provide a high-definition display apparatus.

In order to reduce the number of components composing the pixel circuit and the number of lines connected to/in the pixel circuit, inventors of the present invention have proposed an organic EL display apparatus designed to employ pixel circuits each having a configuration in which, typically, the power-supply electric potential supplied to the device driving transistor can be switched from one level to another and vice versa;

a transistor for controlling the light emission state and no-light emission state of the organic EL device can thus be eliminated because the control of the light emission state and no-light emission state of the organic EL device can be executed by switching the power-supply electric potential supplied to the device driving transistor from one level to another and vice versa;

a transistor for initializing an electric potential appearing on the source electrode of the device driving transistor is also eliminated; and the reference electric potential is supplied as the gate electric potential to the gate electrode of the device driving transistor by way of the signal writing transistor from the same signal line supplying the video-signal voltage as the gate electric potential to the gate electrode of the device driving transistor by way of the signal writing transistor so that a transistor for initializing an electric potential appearing on the gate electrode of the device driving transistor can thus be eliminated.

For details of the proposed organic EL display apparatus, the reader is suggested to refer to Japanese Patent Application No. 2006-141836.

In accordance with the proposed configuration of the pixel circuit, the pixel circuit employs only the minimum number of configuration elements that are required. To put it concretely, the pixel circuit includes:

an organic EL device serving as an electro optical device;

a signal writing transistor for storing the voltage of a video signal representing luminance information into a storage capacitor connected to the gate electrode of a device driving transistor in the pixel circuit;

the storage capacitor connected to the gate electrode of a device driving transistor as a capacitor for holding a voltage stored by the signal writing transistor as the voltage of a video signal; and the device driving transistor for driving the organic EL device on the basis of a voltage held in the storage capacitor as the voltage of a video signal.

In the case of the pixel circuit described above, a threshold-voltage correction process is carried out by applying a reference electric potential Vofs to the gate electrode of the device driving transistor through a signal line and the signal writing transistor, which is put in a conductive state, in order to correct the luminance of light emitted by the organic EL device for variations of the threshold voltage Vth of the device driving transistor from pixel to pixel. When the signal writing transistor is put in a non-conductive state at the end of the period of the threshold-voltage correction process, the gate electrode of the device driving transistor is electrically disconnected from the signal line and put in a floating state before the signal writing transistor is put in a conductive state again in order to store the voltage of a video signal into the storage capacitor connected to the gate electrode of the device driving transistor in a signal write process after the threshold-voltage correction process. Thus, the gate electrode of the device driving transistor is in a floating state during a period between the end of the threshold-voltage correction process and the start of the signal write process.

With the gate electrode of the device driving transistor put in a floating state as described above, electric potentials appearing on the gate and source electrodes of the device driving transistor rise due to a leak current flowing through the device driving transistor as a leak current that can be avoided by the present invention as will be described later in detail. Thus, without the present invention, there is concern that the pixel circuit raises a problem of impossibility to store a video signal normally in a process to store the voltage of the video signal into the storage capacitor employed in the pixel circuit after the threshold-voltage correction process, particularly, in a process to store a low voltage of the video signal into the storage capacitor after the threshold-voltage correction process because the electric potential appearing on the gate electrode of the device driving transistor has risen to a level which is too high for (or even higher than) the voltage of the video signal to be stored into the storage capacitor.

In order to solve the problems described above, the inventors of the present invention have innovated a display apparatus capable of storing a video signal into the storage capacitor employed in each pixel circuit normally even if the gate electrode of the device driving transistor employed in the pixel circuit is put in a floating state and innovated a driving method for driving the display apparatus as well as electronic instruments each employing the display apparatus.

A display apparatus according to an embodiment of the present invention employs a pixel array section including pixel circuits laid out to form a matrix as pixel circuits each having: an electro optical device; a signal writing transistor having the gate electrode thereof connected to a scan line and a particular one of electrodes thereof connected to a signal line; a device driving transistor having the gate electrode thereof connected to the other electrode of the signal writing transistor, a specific one of electrodes thereof connected to a power-supply line and the other electrode thereof connected to the anode electrode of the electro optical device; and a storage capacitor having one of electrodes thereof connected to the gate electrode of the device driving transistor as well as the other electrode of the signal writing transistor and the other electrode thereof connected to the other electrode of the device driving transistor as well as the anode electrode of the electro optical device. The display apparatus further employs: a power-supply scan circuit for selectively supplying a first power-supply electric potential or a second power-supply electric potential lower than the first power-supply electric potential to the specific electrode of the device driving transistor through the power-supply line; a signal outputting circuit for selectively outputting a video signal or a reference electric potential to the particular electrode of the signal writing transistor through the signal line; and a write scan circuit for supplying a write pulse to the gate electrode of the signal writing transistor through the scan line when the signal outputting circuit is outputting the video signal or the reference electric potential to the particular electrode of the signal writing transistor through the signal line. In the display apparatus, after an electric potential appearing on the gate electrode of the device driving transistor has been initialized at an initialization electric potential equal to the reference electric potential in an operation carried out by the signal writing transistor to store the reference electric potential into the storage capacitor connected to the gate electrode of the device driving transistor, a threshold-voltage correction process is carried out to change an electric potential appearing on the other electrode of the device driving transistor toward an electric-potential level obtained by subtracting the threshold voltage of the device driving transistor from the reference electric potential which is the initialization electric potential of the gate electrode of the device driving transistor, and the write scan circuit supplies a write pulse to the gate electrode of the signal writing transistor when the signal outputting circuit is outputting the reference electric potential to the particular electrode of the signal writing transistor as a write pulse having a waveform height greater than the waveform height of a write pulse supplied by the write scan circuit to the gate electrode of the signal writing transistor when the signal outputting circuit is outputting the video signal to the particular electrode of the signal writing transistor.

In a display apparatus having the configuration described above and in an electronic instrument employing the display apparatus, after an electric potential appearing on the gate electrode of the device driving transistor has been initialized at an initialization electric potential equal to the reference electric potential in an operation carried out by the signal writing transistor, which is put in a conductive state by a write pulse output by the write scan circuit to the gate electrode of the signal writing transistor, to store the reference electric potential asserted by the signal outputting circuit on the signal line into the storage capacitor connected to the gate electrode of the device driving transistor, a threshold-voltage correction process is carried out to change an electric potential appearing on the other electrode of the device driving transistor toward an electric-potential level obtained by subtracting the threshold voltage of the device driving transistor from the reference electric potential serving as the initialization electric potential of the gate electrode of the device driving transistor. Subsequently, when the signal writing transistor is put in a non-conductive state at the end of the period of the threshold-voltage correction process, the gate electrode of the device driving transistor is electrically disconnected from the signal line and put in a floating state before the signal writing transistor is put in a conductive state again in order to store the voltage of a video signal into the storage capacitor connected to the gate electrode of the device driving transistor employed in the pixel circuit in a signal write process. Thus, the gate electrode of the device driving transistor is in a floating state during a period between the end of the threshold-voltage correction process and the start of the signal write process.

When the write pulse applied to the gate electrode of the signal writing transistor is changed from a high level typically representing an active state to the 0 level typically representing an inactive state to result in a transition of the signal writing transistor from a conductive state to a non-conductive state at the end of the threshold-voltage correction process, the abrupt change of the write pulse is passed on to the gate electrode of the device driving transistor through the drain electrode of the signal writing transistor due to a coupling effect exhibited by a parasitic capacitor, which exists between the gate and drain electrodes of the signal writing transistor, so that an electric potential appearing on the gate electrode of the device driving transistor also changes as well because the gate electrode of the device driving transistor is connected to the drain electrode of the signal writing transistor. By the same token, the write pulse applied to the gate electrode of the signal writing transistor is also changed from a high level to the 0 level at the end of a signal write process carried out to store a video signal asserted by the signal outputting circuit on the signal line into the storage capacitor after the threshold-voltage correction process so that the electric potential appearing on the gate electrode of the device driving transistor also changes at the end of the signal write process due to the same coupling effect. As described earlier, however, the write pulse applied to the gate electrode of the signal writing transistor in a threshold-voltage correction process has a waveform height greater than the waveform height of the write pulse applied to the gate electrode of the signal writing transistor in a signal write process. Thus, the change observed at the end of the threshold-voltage correction process as the change of the electric potential appearing on the gate electrode of the device driving transistor is greater than the change observed in a case in which the waveform height is made uniform for write pulses. As a result, a voltage appearing between the gate and source electrodes of the device driving transistor at the end of the threshold-voltage correction process decreases, putting the device driving transistor in a cut-off state so that no leak current mentioned before flows through the device driving transistor. With the leak current prevented from flowing through the device driving transistor, during the period of a floating state of the gate electrode of the signal writing transistor, the electric potential appearing on the gate electrode of the device driving transistor is also prevented from rising to a level which is too high for (or even higher than) the voltage of a video signal to be stored into the storage capacitor.

In accordance with the present invention, during a period in which the gate electrode of the device driving transistor is in a floating state, it is possible to prevent an electric potential appearing on the gate electrode of the device driving transistor from rising due to a leak current flowing through the device driving transistor. Thus, even in a process to store a low voltage of a video signal into the storage capacitor employed in the pixel circuit after the threshold-voltage correction process in particular, the video signal can be stored normally into the storage capacitor. As a result, the display quality can be improved.

BRIEF DESCRIPTION OF THE DRAWINGS

FIG. 9A is a diagram showing two curves for different pixel circuits A and B respectively which are subjected to neither a threshold-voltage correction process nor a mobility correction process; FIG. 9B is a diagram showing two curves for different pixel circuits A and B respectively which are subjected to a threshold-voltage correction process but not subjected to a mobility correction process; and FIG. 9C is a diagram showing two curves for different pixel circuits A and B respectively which are subjected to both a threshold-voltage correction process and a mobility correction process;

FIG. 18A is a diagram of the digital camera seen from a position on the front side of the digital camera; and FIG. 18B is a diagram of the digital camera seen from a position on the rear side of the digital camera;

FIG. 21A is a diagram showing the front view of the cellular phone in a state of being already opened; FIG. 21B is a diagram showing a side of the cellular phone in a state of being already opened; FIG. 21C is a diagram showing the front view of the cellular phone in a state of being already closed; FIG. 21D is a diagram showing the left side of the cellular phone in a state of being already closed; FIG. 21E is a diagram showing the right side of the cellular phone in a state of being already closed; FIG. 21F is a diagram showing the top view of the cellular phone in a state of being already closed; and FIG. 21G is a diagram showing the bottom view of the cellular phone in a state of being already closed.

DETAILED DESCRIPTION OF THE PREFERRED EMBODIMENTS

Embodiments of the present invention are explained in detail by referring to diagrams as follows.

System Configuration

Figure 1:
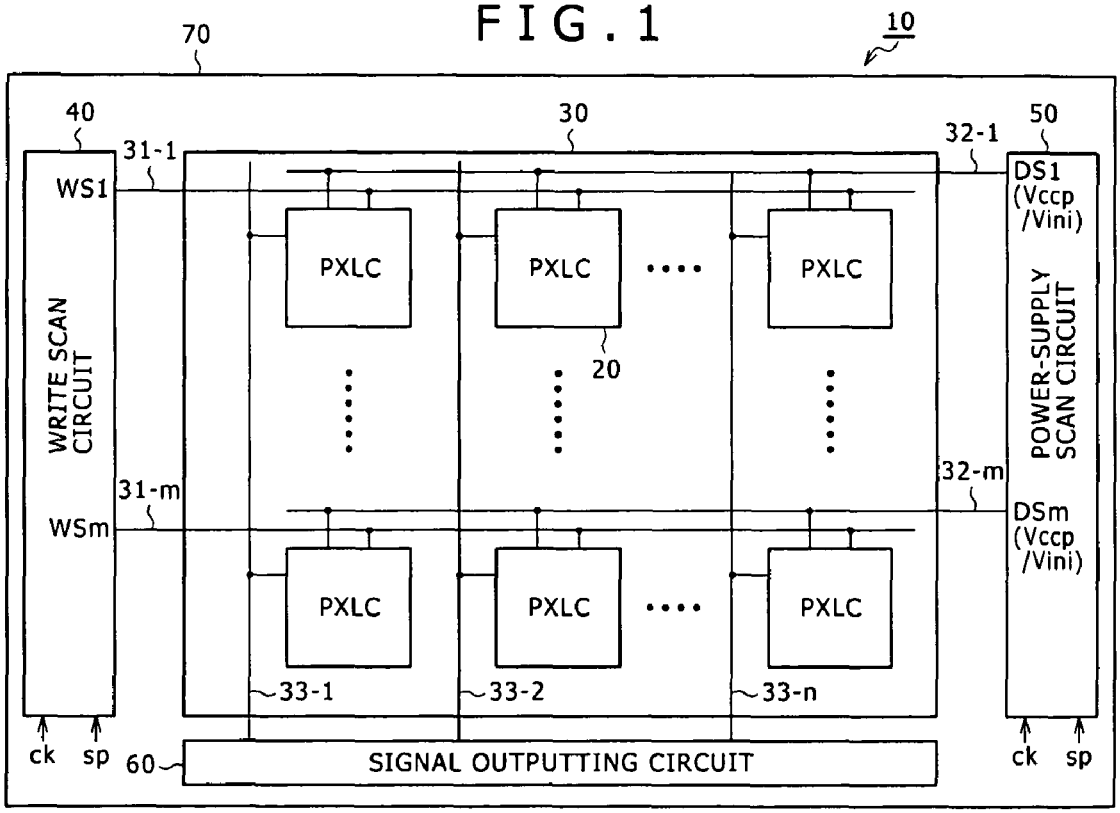
FIG. 1 is a block diagram showing a rough configuration of an active-matrix organic EL display apparatus to which an embodiment of the present invention is applied.

FIG. 1 is a block diagram showing a rough system configuration of an active-matrix organic EL (Electro Luminescence) display apparatus to which an embodiment of the present invention is applied.

An example of the active-matrix display apparatus explained below is an active-matrix organic EL display apparatus 10 making use of current-driven electro optical devices as the light emitting devices each employed in one of pixel circuits included in the active-matrix organic EL display apparatus 10. The current-driven electro optical device changes its light emission luminance in accordance with the magnitude of a current flowing through the device. An example of the current-driven electro optical device is an organic EL device.

As shown in the block diagram of FIG. 1, the active-matrix organic EL display apparatus 10 has a configuration including a pixel array section 30 and driving sections placed in the peripheries of the pixel array section 30 as driving sections each used for driving pixel circuits (PXLCs) 20 employed in the pixel array section 30. In the pixel array section 30, the pixel circuits 20 each including a light emitting device are arranged two-dimensionally to form a pixel matrix. The driving sections are typically a write scan circuit 40, a power-supply scan circuit 50 and a signal outputting circuit 60.

In the case of an active-matrix organic EL display apparatus 10 for color displaying, each of the pixel circuits 20 includes a plurality of sub-pixel circuits each functioning as a pixel circuit 20. To put it more concretely, in an active-matrix organic EL display apparatus 10 for showing a color display, each of the pixel circuits 20 includes three sub-pixel circuits, i.e., a sub-pixel circuit for emitting red light (that is, light of the R color), a sub-pixel circuit for emitting green light (that is, light of the G color) and a sub-pixel circuit for emitting blue light (that is, light of the B color).

However, combinations of sub-pixel circuits functioning as a pixel circuit are by no means limited to the above combination of the sub-pixel circuits for the three primary colors, i.e., the R, G and B colors. For example, a sub-pixel circuit of another color or even a plurality of sub-pixel circuits for a plurality of other colors can be added to the sub-pixel circuits for the three primary colors to function as a pixel circuit. To put it more concretely, for example, a sub-pixel circuit for generating light of the white (W) color for increasing the luminance can be added to the sub-pixel circuits for the three primary colors to function as a pixel circuit. As another example, sub-pixel circuits each used for generating light of a complementary color are added to the sub-pixel circuits for the three primary colors to function as a pixel circuit with an increased color reproduction range.

For the m-row/n-column matrix of pixel circuits 20 arranged to form m rows and n columns in the pixel array section 30, scan lines 31-1 to **31-*m* and power-supply lines 32-1 and 32-*m* are provided, being oriented in a first direction which is the left-to-right direction or the horizontal direction in the block diagram of FIG. 1. To be more specific, each of the scan lines 31-1 to 31-*m* and each of the power-supply lines 32-1 and 32-*m* are provided for each of the m rows of the matrix of pixel circuits 20. In addition, the m-row/n-column matrix of pixel circuits 20 in the pixel array section 30 is also provided with signal lines 33-1 to 33-*n* each oriented in a second direction which is the up-down direction or the vertical direction and perpendicular to the first direction in the block diagram of FIG. 1. To be more specific, each of the signal lines 33-1 to 33-*n* is provided for each of the n columns of the matrix of pixel circuits 20**.

Any specific one of the scan lines 31-1 to **31-*m* is connected to an output terminal employed in the write scan circuit 40 as an output terminal associated with a row for which the specific scan line 31 is provided. By the same token, any specific one of the power-supply lines 32-1 to 32-*m* is connected to an output terminal employed in the power-supply scan circuit 50 as an output terminal associated with a row for which the specific power-supply line 32 is provided. On the other hand, any specific one of the signal lines 33-1 to 33-*n* is connected to an output terminal employed in the signal outputting circuit 60 as an output terminal associated with a column for which the specific signal line 33** is provided.

The pixel array section 30 is normally created on a transparent insulation substrate such as a glass substrate. Thus, the active-matrix organic EL display apparatus 10 can be constructed to have a flat panel structure. Each of the write scan circuit 40, the power-supply scan circuit 50 and the signal outputting circuit 60 each functioning as a driving circuit for driving the pixel circuits 20 included in the pixel array section 30 can be composed of amorphous silicon TFTs (Thin Film Transistors) or low-temperature silicon TFTs. If low-temperature silicon TFTs are used, the write scan circuit 40, the power-supply scan circuit 50 and the signal outputting circuit 60 can also be created on a display panel 70 (or the substrate) composing the pixel array section 30.

The write scan circuit 40 includes a shift register for sequentially shifting (propagating) a start pulse sp in synchronization with a clock pulse signal ck. In an operation to write video signals into the pixel circuits 20 employed in the pixel array section 30, the write scan circuit 40 sequentially supplies the start pulse sp as one of write pulses (or scan signals) WS1 to WSm to one of the scan lines 31-1 to **31-*m*. The write pulses supplied to the scan lines 31-1 to 31-*m* are thus used for scanning the pixel circuits 20 employed in the pixel array section 30 sequentially in row units in the so-called a line-by-line sequential scan operation to put pixel circuits 20** provided on the same row in a state of being enabled to receive the video signals at one time.

By the same token, the power-supply scan circuit 50 also includes a shift register for sequentially shifting (propagating) a start pulse sp in synchronization with a clock pulse signal ck. In synchronization with the line-by-line sequential scan operation carried out by the write scan circuit 40, that is, with timings determined by the start pulse sp, the power-supply scan circuit 50 supplies power-supply line electric potentials DS1 to DSm to the power-supply lines 32-1 to **32-*m* respectively. Each of the power-supply line electric potentials DS1 to DSm is switched from a first power-supply electric potential Vccp to a second power-supply electric potential Vini lower than the first power-supply electric potential Vccp and vice versa in order to control the light emission state and no-light emission state of the pixel circuits 20 in row units and in order to supply a current to organic EL devices, which are each employed in the pixel circuit 20** as a light emitting device, in row units.

The signal outputting circuit 60 properly selects the voltage Vsig of a video signal representing luminance information received from a signal source not shown in the block diagram of FIG. 1 or a reference electric potential Vofs and writes the selected one to the pixel circuits 20 employed in the pixel array section 30 typically in row units through the signal lines 33-1 to **33-*n*. The reference electric potential Vofs is the aforementioned initialization electric potential of the gate electrode of a device driving transistor 22 employed in the pixel circuit 20. In the following description, the video-signal voltage Vsig, which is the voltage of a video signal representing luminance information received from the signal source, is also referred to as a signal voltage. That is to say, the signal outputting circuit 60 adopts a driving method of a line-by-line sequential writing operation for writing the video-signal voltage Vsig into pixel circuits 20** in a state of being enabled to receive the video-signal voltage Vsig in row units.

The reference electric potential Vofs is an electric potential used as a reference of the video-signal voltage Vsig representing luminance information received from the signal source. The reference electric potential Vofs is typically an electric potential representing the black level. The second power-supply electric potential Vini mentioned above is lower than the reference electric potential Vofs. For example, the second power-supply electric potential Vini is lower than (Vofs−Vth) where notation Vth denotes the threshold voltage of a device driving transistor 22 employed in the pixel circuit 20. It is desirable to set the second power-supply electric potential Vini at an electric potential sufficiently lower than (Vofs−Vth).

Pixel Circuits

Figure 2:
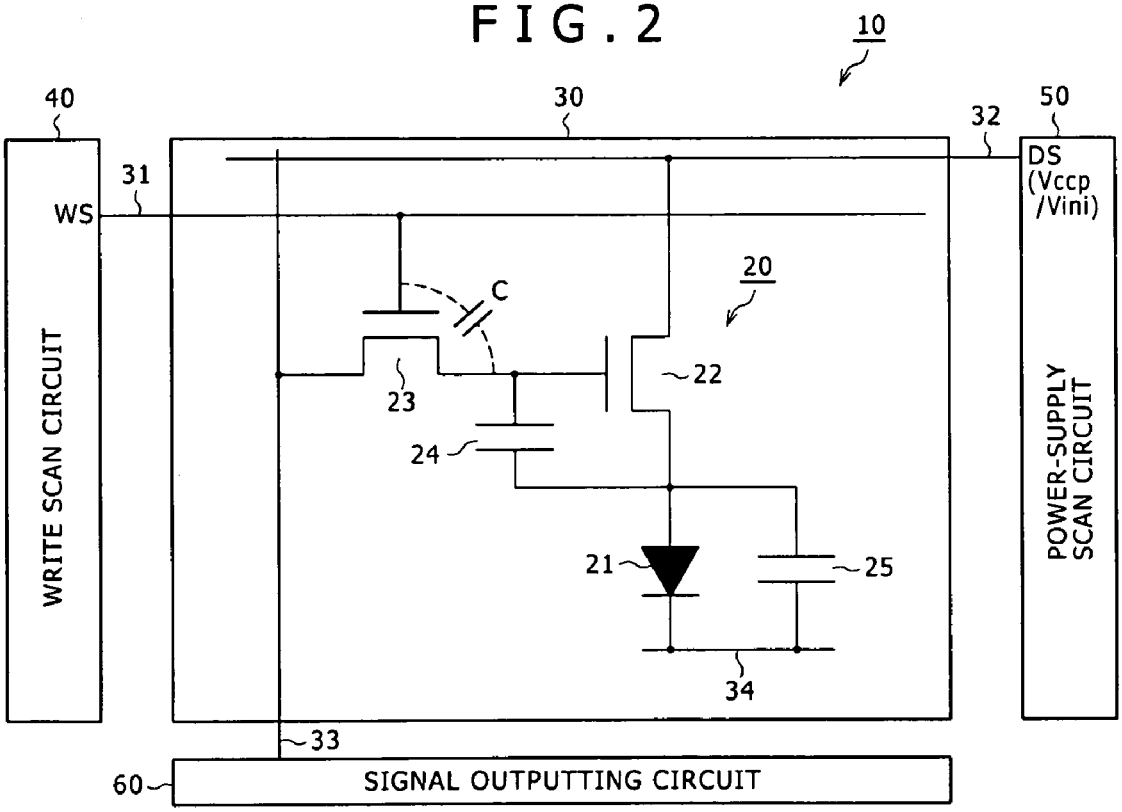
FIG. 2 is a diagram showing a concrete typical configuration of a pixel circuit employed in the organic EL display apparatus.

FIG. 2 is a diagram showing a concrete typical configuration of the pixel circuit 20.

As shown in the diagram of FIG. 2, driven by the write scan circuit 40, the power-supply scan circuit 50 and the signal outputting circuit 60, the pixel circuit 20 includes an organic EL device 21 serving as an electro optical device which changes the luminance of light generated thereby in accordance with the magnitude of a current flowing through the device. The cathode electrode of the organic EL device 21 is connected to a common power-supply line 34 common to all pixel circuits 20. The common power-supply line 34 is also referred to as a beta line.

In addition to the organic EL device 21, the pixel circuit 20 also has driving components including the device driving transistor 22 mentioned above, a signal writing transistor 23, a storage capacitor 24 and a supplementary capacitor 25. In the typical configuration of the pixel circuit 20, each of the device driving transistor 22 and the signal writing transistor 23 is an N-channel TFT. However, conduction types of the device driving transistor 22 and the signal writing transistor 23 are by no means limited to the N-channel conduction type. That is to say, the conduction types of the device driving transistor 22 and the signal writing transistor 23 can each be another conduction type or can be conduction types different from each other.

It is to be noted that, if an N-channel TFT is used as each of the device driving transistor 22 and the signal writing transistor 23, an amorphous silicon (a-Si) process can be applied to the fabrication of the pixel circuit 20. By applying the amorphous silicon (a-Si) process to the fabrication of the pixel circuit 20, it is possible to reduce the cost of a substrate on which the TFTs are created and, hence, reduce the cost of the active-matrix organic EL display apparatus 10 itself. In addition, if the device driving transistor 22 and the signal writing transistor 23 have the same conduction type, the same process can be used for creating the device driving transistor 22 and the signal writing transistor 23. Thus, the same conduction type of the device driving transistor 22 and the signal writing transistor 23 contributes to the cost reduction.

One of the electrodes (that is, either the source or drain electrode) of the device driving transistor 22 is connected to the anode electrode of the organic EL device 21 whereas the other electrode (that is, either the drain or source electrode) of the device driving transistor 22 is connected to the power-supply line 32, that is, one of the power-supply lines 32-1 to **32-*m***.

The gate electrode of the signal writing transistor 23 is connected to the scan line 31, that is, one of the scan lines 31-1 to **31-*m*. One of the electrodes (that is, either the source or drain electrode) of the signal writing transistor 23 is connected to the signal line 33, that is, one of the signal lines 33-1 to 33-*n*, whereas the other electrode (that is, either the drain or source electrode) of the signal writing transistor 23 is connected to the gate electrode of the device driving transistor 22**.

In the device driving transistor 22 and the signal writing transistor 23, one of the electrodes is a metallic wire connected to the source or drain electrode whereas the other electrode is a metallic wire connected to the drain or source electrode. In addition, in accordance with a relation between an electric potential appearing on one of the electrodes and an electric potential appearing on the other electrode, one of the electrodes becomes a source or drain electrode whereas the other electrode becomes the drain or source electrode.

One of the electrodes of the storage capacitor 24 is connected to the gate electrode of the device driving transistor 22 and the other electrode of the signal writing transistor 23 whereas the other electrode of the storage capacitor 24 is connected to one of the electrodes of the device driving transistor 22 and the anode electrode of the organic EL device 21.

One of the electrodes of the supplementary capacitor 25 is connected to the anode electrode of the organic EL device 21, one of the electrodes of the device driving transistor 22 and the other electrode of the storage capacitor 24 whereas the other electrode of the supplementary capacitor 25 is connected to the common power-supply line 34 and the cathode electrode of the organic EL device 21. The supplementary capacitor 25 is a capacitor for correcting the organic EL device 21 for an insufficiency of the capacitance of the organic EL device 21 and installed if necessary as a capacitor for increasing a write gain in an operation to store a video signal into the storage capacitor 24. That is to say, the supplementary capacitor 25 is not a capacitor required absolutely. If the capacitance of the organic EL device 21 is sufficiently large, the supplementary capacitor 25 can be eliminated.

In the above typical configuration of the pixel circuit 20, the other electrode of the supplementary capacitor 25 is connected to the common power-supply line 34. However, the other electrode of the supplementary capacitor 25 does not have to be connected to the common power-supply line 34. That is to say, the other electrode of the supplementary capacitor 25 can be connected to another node having a fixed electric potential in order to achieve the desired objects to correct the organic EL device 21 for an insufficiency of the capacitance of the organic EL device 21 and increase a write gain in an operation to store a video signal into the storage capacitor 24.

In the pixel circuit 20 having the configuration described above, the signal writing transistor 23 is put in a conductive state by a high-level scan signal WS applied by the write scan circuit 40 to the gate electrode of the signal writing transistor 23 through the scan line 31, that is, one of the scan lines 31-1 to **31-*m*. In this conductive state of the signal writing transistor 23, the signal writing transistor 23 samples the video-signal voltage Vsig supplied by the signal outputting circuit 60 through the signal line 33 (that is, one of the signal lines 33-1 to 33-*n*) as a voltage having a magnitude representing luminance information or samples the offset voltage Vofs also supplied by the signal outputting circuit 60 through the signal line 33 and writes the sampled video-signal voltage Vsig or offset voltage Vofs into the pixel circuit 20. The sampled video-signal voltage Vsig or offset voltage Vofs is applied to the gate electrode of the device driving transistor 22 and stored in the storage capacitor 24**.

With the first power-supply electric potential Vccp asserted on the power-supply line 32 (that is, one of the power-supply lines 32-1 to **32-*m*) as the electric potential DS, one of the electrodes of the device driving transistor 22 becomes the drain electrode whereas the other electrode of the device driving transistor 22 becomes the source electrode. In the electrodes of the device driving transistor 22 functioning in this way, the device driving transistor 22 is operating in a saturated region and flowing a current received from the power-supply line 32 to the organic EL device 21 as a current for driving the organic EL device 21 into a state of emitting light. To put it more concretely, the device driving transistor 22 is operating in a saturated region to supply a driving current serving as a light emission current having a magnitude according to the magnitude of the video-signal voltage Vsig stored in the storage capacitor 24 to the organic EL device 21. The organic EL device 21** thus emits light with a luminance according to the magnitude of the driving current in a light emission state.

When the first power-supply electric potential Vccp asserted on the power-supply line 32 (that is, one of the power-supply lines 32-1 to **32-*m*) as the electric potential DS is changed to the second power-supply electric potential Vini, the device driving transistor 22 operates as a switching transistor. When operating as a switching transistor, one of the electrodes of the device driving transistor 22 becomes the source electrode whereas the other electrode of the device driving transistor 22 becomes the drain electrode. As such a switching transistor, the device driving transistor 22 stops the operation to supply the driving current to the organic EL device 21, putting the organic EL device 21 in a no-light emission state. That is to say, the device driving transistor 22 also has a function of a transistor for controlling the light emission and no-light emission states of the organic EL device 21**.

The device driving transistor 22 carries out a switching operation in order to set a no-light emission period for the organic EL device 21 as the period of a no-light emission state and control a duty which is defined as a ratio of the light emission period of the organic EL device 21 to the no-light emission period of the organic EL device 21. By executing such control, it is possible to reduce the amount of blurring caused by a residual image attributed to light generated by pixel circuits throughout one frame. Thus, in particular, the quality of a moving image can be made more excellent.

Pixel Structure

Figure 3:
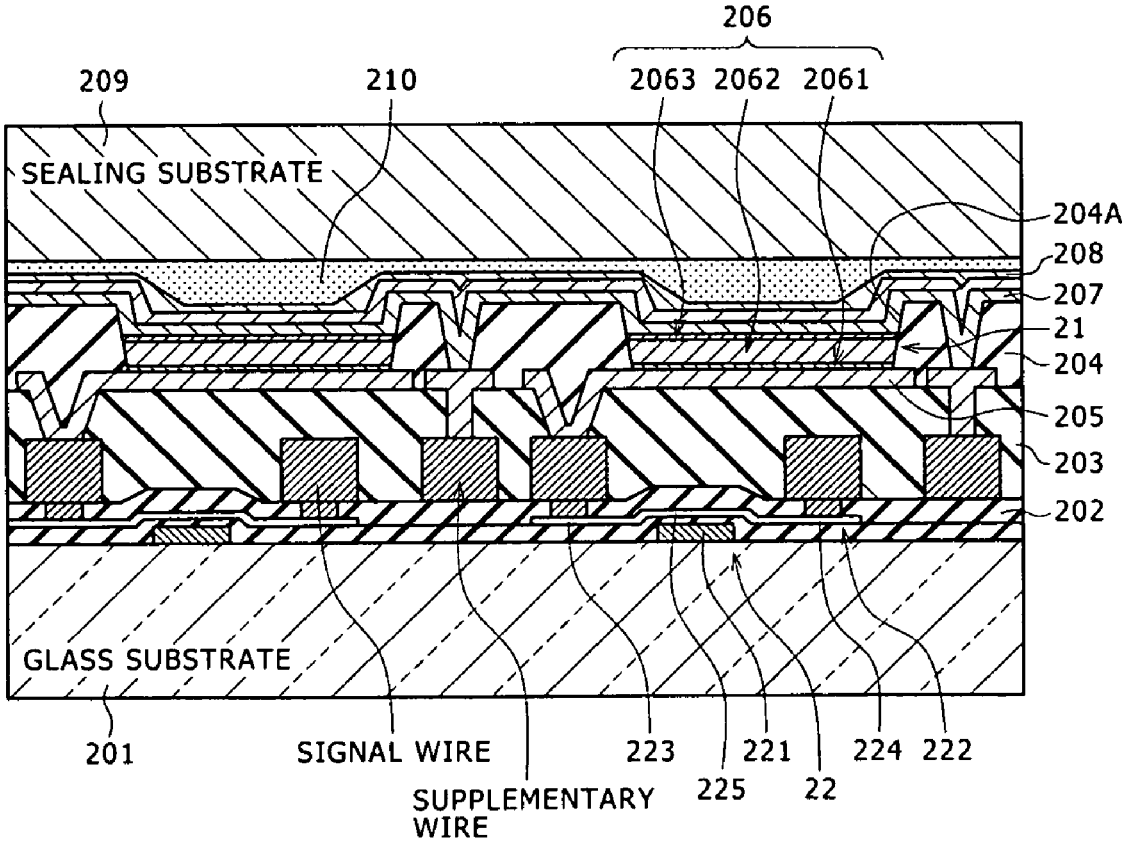
FIG. 3 is a cross-sectional diagram showing the cross section of a typical structure of the pixel circuit.

FIG. 3 is a cross-sectional diagram showing the cross section of a typical structure of the pixel circuit 20. As shown in the cross-sectional diagram of FIG. 3, the structure of the pixel circuit 20 includes a glass substrate 201 over which driving components including the device driving transistor 22 are created. In addition, the structure of the pixel circuit 20 also includes an insulation film 202, an insulation flat film 203 and a window insulation film 204, which are sequentially created on the glass substrate 201 in an order the insulation film 202, the insulation flat film 203 and the window insulation film 204 are enumerated in this sentence. In this structure, the organic EL device 21 is provided on a dent 204A of the window insulation film 204. The cross-sectional diagram of FIG. 3 shows only the device driving transistor 22 of the driving components as a configuration element, omitting the other driving components.

The organic EL device 21 has a configuration including an anode electrode 205, organic layers 206 and a cathode electrode 207. The anode electrode 205 is typically a metal created on the bottom of the dent 204A of the window insulation film 204. The organic layers 206 are an electron transport layer, a light emission layer and a hole transport/injection layer, which are created over the anode electrode 205. Placed on the organic layers 206, the cathode electrode 207 is typically a transparent conductive film created as a film common to all pixel circuits 20.

The organic layers 206 included in the organic EL device 21 are created by sequentially stacking a hole transport layer/hole injection layer 2061, a light emitting layer 2062, an electron transport layer 2063 and an electron injection layer on the anode electrode 205. It is to be noted that the electron injection layer is not shown in the diagram of FIG. 3. In an operation carried out by the device driving transistor 22 to drive the organic EL device 21 to emit light by flowing a current to the organic EL device 21 as shown in the diagram of FIG. 2, the current flows from the device driving transistor 22 to the organic layers 206 by way of the anode electrode 205. With the current flowing to the organic layers 206, holes and electrons are recombined with each other in the light emitting layer 2062, causing light to be emitted.

The device driving transistor 22 is created to have a configuration including a gate electrode 221, a semiconductor layer 222, a source/drain area 223, a drain/source area 224 and a channel creation area 225. In this configuration, the source/drain area 223 is created on one of the sides of the semiconductor layer 222 whereas the drain/source area 224 is created on the other side of the semiconductor layer 222 and the channel creation area 225 faces the gate electrode 221 of the semiconductor layer 222. The source/drain area 223 is electrically connected to the anode electrode 205 of the organic EL device 21 through a contact hole.

As shown in the diagram of FIG. 3, for every pixel circuit 20, an organic EL device 21 is created over the glass substrate 201, sandwiching the insulation film 202, the insulation flat film 203 and the window insulation film 204 between the organic EL device 21 and the glass substrate 201 on which the driving components including the device driving transistor 22 are formed. After organic EL devices 21 are created in this way, a passivation film 208 is created over the organic EL devices 21 and covered by a sealing substrate 209, sandwiching an adhesive 210 between the sealing substrate 209 and the passivation film 208. In this way, the organic EL devices 21 are sealed by the sealing substrate 209, forming a display panel 70.

Ideal Circuit Operations of the Organic EL Display Apparatus

Figure 4:
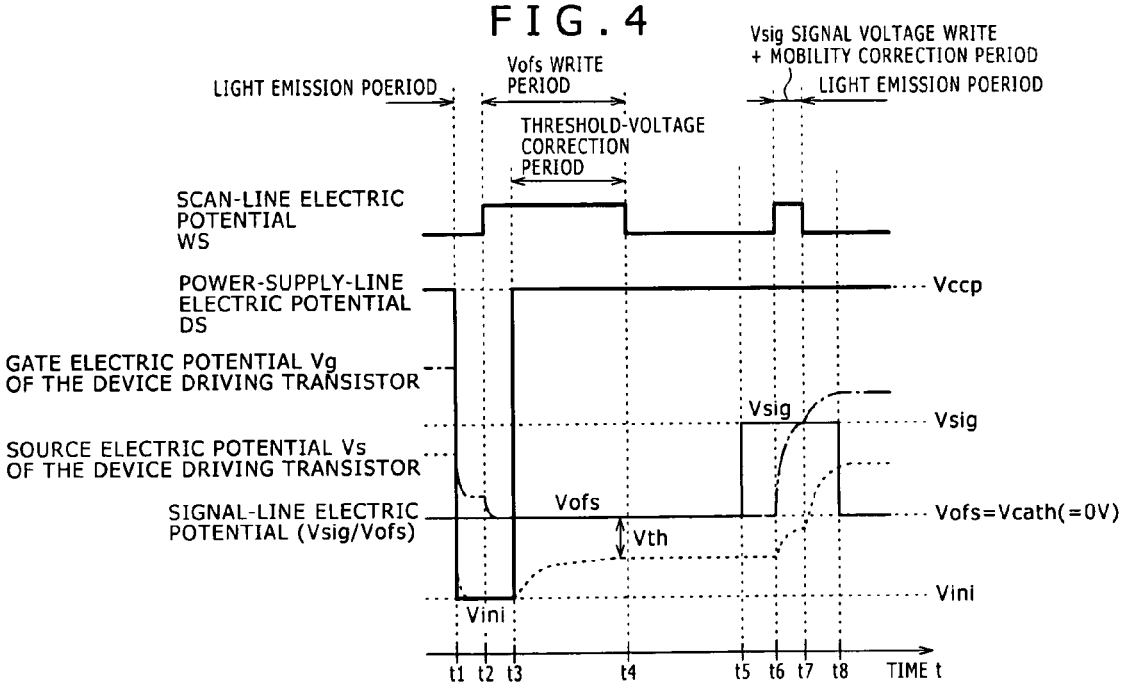
FIG. 4 is a timing/waveform diagram to be referred to in description of operations in an ideal state in an active-matrix organic EL display apparatus to which an embodiment of the present invention is applied.

Next, by referring to a timing/waveform diagram of FIG. 4 as a base as well as circuit diagrams of FIGS. 5 and 6, the following description explains ideal circuit operations carried out by the active-matrix organic EL display apparatus 10 employing pixel circuits 20 laid out two-dimensionally to form a matrix.

It is to be noted that in the circuit-operation explanatory diagrams of FIGS. 5 and 6, the signal writing transistor 23 is shown as a symbol, which represents a switch, in order to make the diagrams simple. In addition, a compound capacitor Csub is shown in each of the circuit-operation explanatory diagrams of FIGS. 5 and 6 as a capacitor having a compound capacitance equal to the sum of the capacitances of the organic EL device 21 and the supplementary capacitor 25 which are connected to each other to form a parallel circuit.

The timing/waveform diagram of FIG. 4 shows variations of an electric potential (a scan signal or a write pulse) WS appearing on the scan line 31 (any one of the scan lines 31-1 to **31-*m*), variations of an electric potential DS appearing on the power-supply line 32 (any one of the power-supply lines 32-1 to 32-*m*), variations of a gate electric potential Vg appearing on the gate electrode of the device driving transistor 22 and variations of a source electric potential Vs appearing on the source electrode of the device driving transistor 22**.

Light Emission Period of the Preceding Frame

In the timing/waveform diagram of FIG. 4, a period prior to a time t1 is a light emission period of the organic EL device 21 in an immediately preceding frame. In a light emission period, the electric potential DS appearing on the power-supply line 32 is the first power-supply electric potential Vccp also referred to hereafter as a high electric potential and the signal writing transistor 23 is in a non-conductive state.

With the first power-supply electric potential Vccp asserted on the power-supply line 32 and applied to the device driving transistor 22, the device driving transistor 22 is set to operate in a saturated region. Thus, in the light emission period, a driving current (that is, a light emission current or a drain-source current Ids flowing between the drain and source electrodes of the device driving transistor 22) according to the gate-source voltage Vgs applied between the gate and source electrodes of the device driving transistor 22 flows from the power-supply line 32 to the organic EL device 21 by way of the device driving transistor 22 as shown in the circuit diagram of FIG. 5A. As a result, the organic EL device 21 emits light having a luminance proportional to the magnitude of the driving current Ids. The waveform of the gate electric potential Vg is shown by a dotted-dashed line whereas the waveform of the source electric potential Vs is shown by a dotted line so that these waveforms can be distinguished from each other.

Threshold-Voltage Correction Preparation Period

Then, at the time t1, a new frame (referred to as a present frame in the timing/waveform diagram of FIG. 4) of the line-by-line sequential scan operation arrives. As shown in the circuit diagram of FIG. 5B, the electric potential DS appearing on the power-supply line 32 is changed from the high electric potential Vccp to the second power-supply electric potential Vini. Also referred to hereafter as a low electric potential, typically, the low electric potential Vini is sufficiently lower than (Vofs−Vth).

Let us assume that the low electric potential Vini satisfies the relation Vini<(Vel+Vcath) where notation Vel denotes the threshold voltage of the organic EL device 21 whereas notation Vcath denotes an electric potential appearing on the common power-supply line 34. In this case, since a source electric potential Vs appearing on the source electrode of the device driving transistor 22 is about equal to the low electric potential Vini, the organic EL device 21 is put in a reversed-bias state, ceasing to emit light.

Figure 5A:
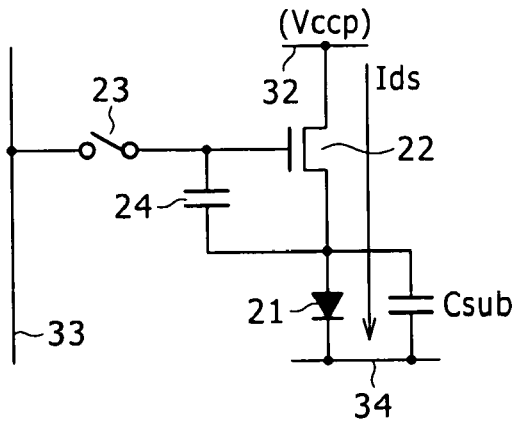
FIGS. 5A to 6D are a plurality of explanatory diagrams to be referred to in description of the first part of circuit operations in the ideal state.
Figure 5B:
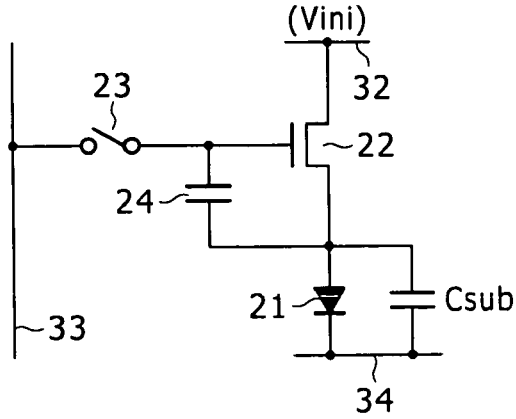
Figure 5C:
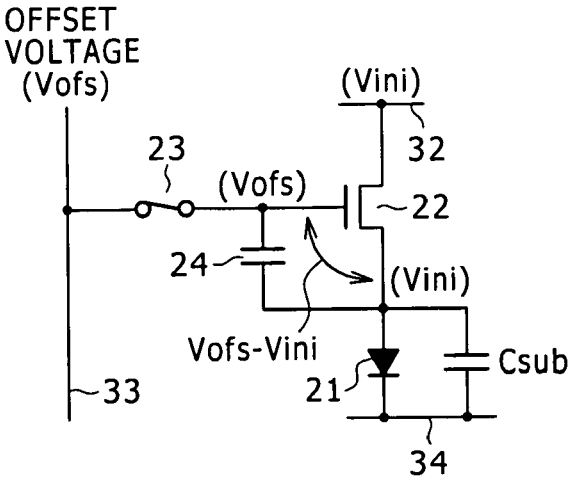

Then, at a later time t2, the electric potential WS appearing on the scan line 31 is changed from a low level to a high level, putting the signal writing transistor 23 in a conductive state as shown in the circuit diagram of FIG. 5C. In this state, the signal outputting circuit 60 asserts the reference electric potential Vofs on the signal line 33 and the reference electric potential Vofs is applied to the gate electrode of the device driving transistor 22 as the gate electric potential Vg by way of the signal writing transistor 23. As described above, the low electric potential Vini sufficiently lower than the reference electric potential Vofs is supplied to the source electrode of the device driving transistor 22 as the source electric potential Vs at that time.

Thus, at that time, the gate-source voltage Vgs applied between the gate and source electrodes of the device driving transistor 22 is equal to an electric-potential difference of (Vofs−Vini). If the electric-potential difference of (Vofs−Vini) is not greater than the threshold voltage Vth of the device driving transistor 22, the threshold-voltage correction process to be described later cannot be carried out. It is thus necessary to set the electric-potential relation (Vofs−Vini) >Vth.

The initialization process to fix (set) the gate electric potential Vg appearing on the gate electrode of the device driving transistor 22 at the reference electric potential Vofs and the source electric potential Vs appearing on the source electrode of device driving transistor 22 at the low electric potential Vini is a preparation for the threshold-voltage correction process to be described later. In the following description, the preparation for the threshold-voltage correction process is referred to as a threshold-voltage correction preparation process.

Threshold-Voltage Correction Period

Figure 5D:
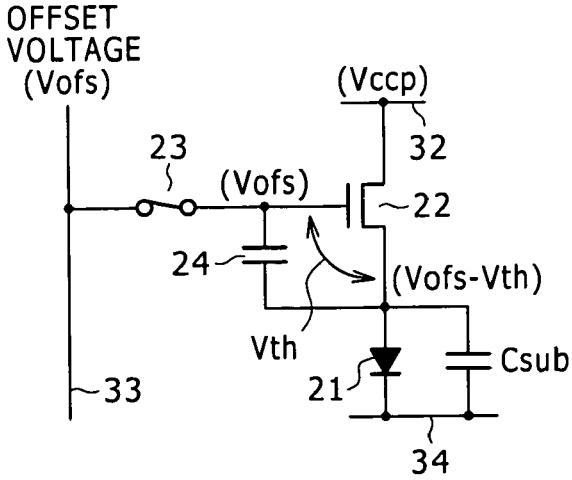

Then, at a later time t3, when the electric potential DS appearing on the power-supply line 32 is changed from the low electric potential Vini to the high electric potential Vccp as shown in the circuit diagram of FIG. 5D, in a state of sustaining the gate electric potential Vg appearing on the gate electrode of the device driving transistor 22 as it is, the source electric potential Vs appearing on the source electrode of the device driving transistor 22 starts to rise toward an electric potential obtained as result of subtracting the threshold voltage Vth of the device driving transistor 22 from the gate electric potential Vg. In due course of time, the voltage Vgs applied between the gate and source electrodes of the device driving transistor 22 is converged to the threshold voltage Vth of the device driving transistor 22, causing a voltage corresponding to the threshold voltage Vth to be stored in the storage capacitor 24.

For the sake of convenience, the initialization electric potential Vofs of the gate electric potential Vg appearing on the gate electrode of the device driving transistor 22 as described above is taken as a reference electric potential. Thus, in a state of sustaining the gate electric potential Vg appearing on the gate electrode of the device driving transistor 22 as it is, the source electric potential Vs appearing on the source electrode of the device driving transistor 22 starts to change (or, to put it concretely, starts to rise) toward an electric potential obtained as result of subtracting the threshold voltage Vth of the device driving transistor 22 from the initialization electric potential Vofs, which is the gate electric potential Vg. Then, a finally converged voltage Vgs appearing between the gate and source electrodes of the device driving transistor 22 is detected as the threshold voltage Vth of the device driving transistor 22 and a voltage corresponding to the threshold voltage Vth is stored in the storage capacitor 24. The process of raising the source electric potential Vs and the process of detecting a finally converged voltage Vgs as the threshold voltage Vth as well as storing the detected voltage Vgs in the storage capacitor 24 as described above are referred to as a threshold-voltage correction process. The time period within which the threshold-voltage correction process is carried out is referred to as a threshold-voltage correction period.

It is to be noted that, in the threshold-voltage correction period, in order to flow the entire driving current to the storage capacitor 24 instead of flowing to the organic EL device 21, the common power-supply line 34 is set at the electric potential Vcath in advance so as to put the organic EL device 21 in a cut-off state.

Figure 6A:
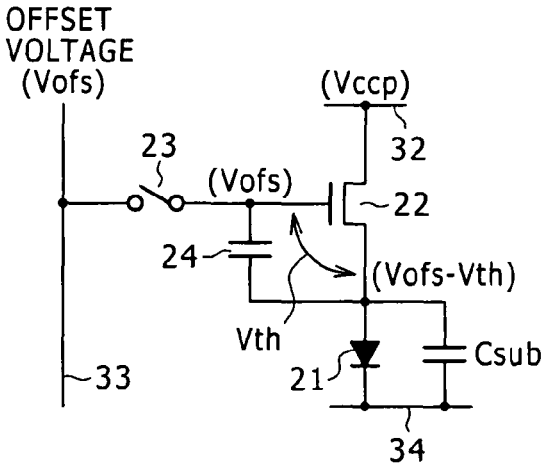

Then, at a later time t4, the electric potential WS appearing on the scan line 31 is changed to a low level in order to put the signal writing transistor 23 in a non-conductive state as shown in the circuit diagram of FIG. 6A. In this non-conductive state of the signal writing transistor 23, the gate electrode of the device driving transistor 22 is electrically disconnected from the signal line 33, entering a floating state. Since the voltage Vgs appearing between the gate and source electrodes of the device driving transistor 22 is equal to the threshold voltage Vth of the device driving transistor 22, however, the device driving transistor 22 is put in a cut-off state. Thus, the drain-source current Ids does not flow through the device driving transistor 22.

Write and Mobility Correction Periods

Figure 6B:
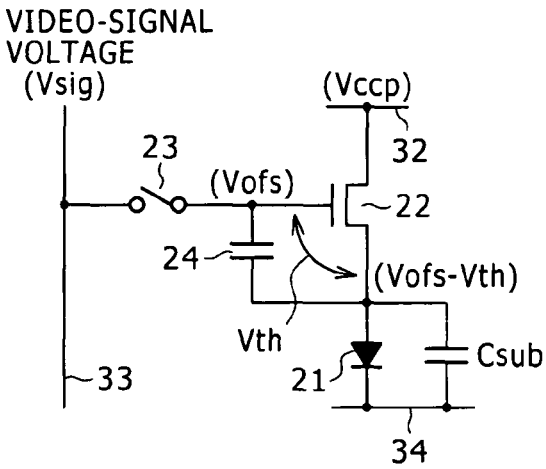
Figure 6C:
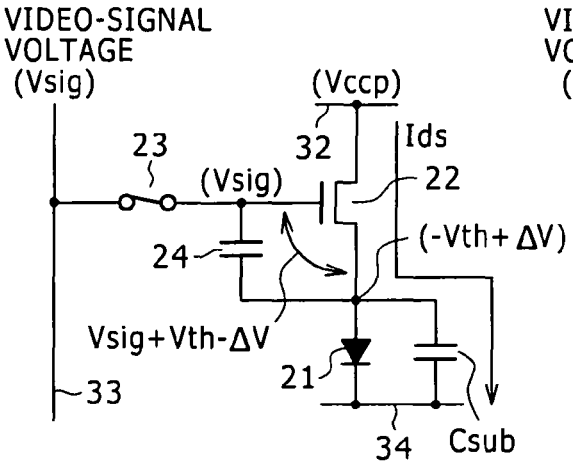

Then, at a later time t5, the electric potential appearing on the signal line 33 is changed from the reference electric potential Vofs to the video-signal voltage Vsig as shown in the circuit diagram of FIG. 6B in order to prepare for a signal writing operation and a mobility correction process. Subsequently, at a later time t6 of the start of the signal write and mobility correction periods, by setting the electric potential WS appearing on the scan line 31 at a high level, the signal writing transistor 23 is put in a conductive state as shown in the circuit diagram of FIG. 6C. In this state, the signal writing transistor 23 samples the video-signal voltage Vsig and stores the sampled video-signal voltage Vsig into the pixel circuit 20.

As a result of the operation carried out by the signal writing transistor 23 to store the sampled video-signal voltage Vsig into the pixel circuit 20, the gate electric potential Vg appearing on the gate electrode of the device driving transistor 22 becomes equal to the video-signal voltage Vsig. In the operation to drive the device driving transistor 22 by making use of the video-signal voltage Vsig, the threshold voltage Vth of the device driving transistor 22 and a voltage stored in the storage capacitor 24 as a voltage corresponding to the threshold voltage Vth kill each other in the so-called threshold-voltage correction process, the principle of which will be described later in detail.

At that time, the organic EL device 21 is initially in a cut-off state (or a high-impedance state). Thus, the drain-source current Ids flowing from the power-supply line 32 to the device driving transistor 22 driven by the video-signal voltage Vsig actually goes to the aforementioned compound apparent capacitor Csub connected in parallel to the organic EL device 21 instead of entering the organic EL device 21 itself. As a result, an electric charging process of the apparent capacitor with the compound capacitor Csub is started.

While the apparent capacitor with the compound capacitor Csub is being electrically charged, the source electric potential Vs appearing on the source electrode of the device driving transistor 22 rises with the lapse of time. Since the drain-source current Ids flowing between the drain and source electrodes of the device driving transistor 22 has already been corrected for the Vth (threshold-voltage) variations from pixel to pixel, the drain-source current Ids varies from pixel to pixel only in accordance with the mobility μ of the device driving transistor 22.

Let us assume that the write gain has an ideal value of 1. The write gain is defined as a ratio of the voltage Vgs observed between the gate and source electrodes of the device driving transistor 22 and stored in the storage capacitor 24 as a voltage corresponding to the threshold voltage Vth of the device driving transistor 22 as described above to the video-signal voltage Vsig. As the source electric potential Vs appearing on the source electrode of the device driving transistor 22 reaches an electric potential of (Vofs−Vth+ΔV), the voltage Vgs observed between the gate and source electrodes of the device driving transistor 22 becomes equal to an electric potential of (Vsig−Vofs+Vth−ΔV) where notation ΔV denotes the increase in source electric potential Vs.

That is to say, a negative feedback operation is carried out so as to subtract the increase ΔV of the source electric potential Vs appearing on the source electrode of the device driving transistor 22 from a voltage stored in the storage capacitor 24 as a voltage of (Vsig−Vofs+Vth) or, in other words, a negative feedback operation is carried out so as to electrically discharge some electric charge from the storage capacitor 24. In the negative feedback operation, the increase ΔV of the source electric potential Vs appearing on the source electrode of the device driving transistor 22 is used as a negative-feedback quantity.

As described above, by negatively feeding the drain-source current Ids flowing between the drain and source electrodes of the device driving transistor 22 back to the gate input of the device driving transistor 22, that is, by negatively feeding the drain-source current Ids flowing between the drain and source electrodes of the device driving transistor 22 back to the voltage Vgs appearing between the gate and source electrodes of the device driving transistor 22, the dependence of the drain-source current Ids on the mobility μ of the device driving transistor 22 can be eliminated. That is to say, in the operation to sample the video-signal voltage Vsig and store the sampled video-signal voltage Vsig into the pixel circuit 20, a mobility correction process is also carried out as well in order to correct the drain-source current Ids flowing between the drain and source electrodes of the device driving transistor 22 for mobility-μ variations from pixel to pixel.

To put it more concretely, the higher the video-signal voltage Vsig stored in the pixel circuit 20, the bigger the drain-source current Ids flowing between the drain and source electrodes of the device driving transistor 22 and, hence, the larger the absolute value of the increase ΔV used as the negative-feedback quantity (or the correction quantity). Thus, it is possible to carry out a mobility correction process according to the level of the luminance of light emitted by the organic EL device 21.

For a fixed video-signal voltage Vsig, the larger the mobility μ of the device driving transistor 22, the bigger the absolute value of the increase ΔV used as the negative-feedback quantity (or the correction quantity). It is thus possible to correct the drain-source current Ids flowing between the drain and source electrodes of the device driving transistor 22 for mobility (μ) variations from pixel to pixel. The principle of the mobility correction process will be described later in detail.

Light Emission Period

Figure 6D:
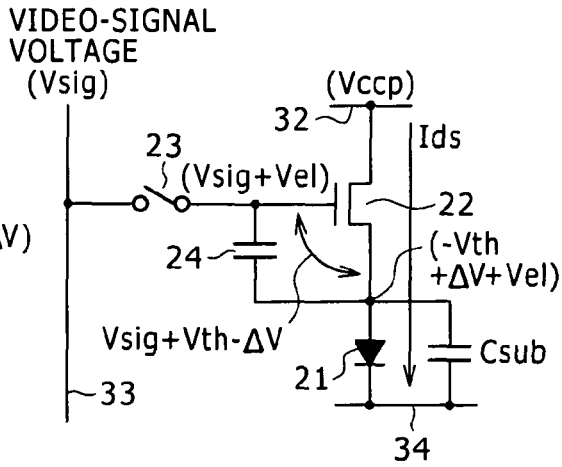

Then, at a later time t7, the electric potential WS appearing on the scan line 31 is changed to a low level in order to put the signal writing transistor 23 in a non-conductive state as shown in the circuit diagram of FIG. 6D. With the electric potential WS put at a low level, the gate electrode of the device driving transistor 22 is electrically disconnected from the signal line 33, entering a floating state.

With the gate electrode of the device driving transistor 22 put in a floating state and the gate as well as source electrodes of the device driving transistor 22 connected to the storage capacitor 24, when the source electric potential Vs appearing on the source electrode of the device driving transistor 22 varies in accordance with the amount of electrical charge stored in the storage capacitor 24, the gate electric potential Vg appearing on the gate electrode of the device driving transistor 22 also varies in a manner of being interlocked with the variation of the source electric potential Vs. The operation in which the gate electric potential Vg appearing on the gate electrode of the device driving transistor 22 also varies in a manner of being interlocked with the variation of the source electric potential Vs appearing on the source electrode of the device driving transistor 22 is referred to as a bootstrap operation of the storage capacitor 24.

With the gate electrode of the device driving transistor 22 put in a floating state, as the drain-source current Ids flowing between the drain and source electrodes of the device driving transistor 22 starts to flow to the organic EL device 21, an electric potential appearing on the anode electrode of the organic EL device 21 rises in accordance with the increase of the drain-source current Ids.

The electric potential appearing on the anode electrode of the organic EL device 21 exceeds an electric potential of (Vel+Vcath), causing the organic EL device 21 to begin emitting light. The increase of the electric potential appearing on the anode electrode of the organic EL device 21 is no other than the increase of the source electric potential Vs appearing on the source electrode of the device driving transistor 22. When the source electric potential Vs appearing on the source electrode of the device driving transistor 22 rises, due to the effect of the bootstrap operation of the storage capacitor 24, the gate electric potential Vg appearing on the gate electrode of the device driving transistor 22 also rises in a manner of being interlocked with the variation of the source electric potential Vs appearing on the source electrode of the device driving transistor 22.

Let us assume that a bootstrap gain has an ideal value of 1 in the bootstrap operation. In this case, the increase of the gate electric potential Vg appearing on the gate electrode of the device driving transistor 22 is equal to the increase of the source electric potential Vs appearing on the source electrode of the device driving transistor 22. Therefore, during a light emission period, the gate-source voltage Vgs applied between the gate and source electrodes of the device driving transistor 22 is sustained at a fixed level of (Vsig−Vofs+Vth−ΔV). Then, at a later time t8, an electric potential appearing on the signal line 33 is changed from the video-signal line voltage Vsig to the offset voltage Vofs.

Principle of the Threshold-Voltage Correction Process

The following description explains the principle of the threshold-voltage correction process. As described before, the device driving transistor 22 is designed to operate in a saturated region. Thus, the device driving transistor 22 works as a constant-current source. As a result, the device driving transistor 22 supplies a constant drain-source current Ids (also referred to as a driving current or a light emission current) given by Eq. (1) to the organic EL device 21.

$$Ids=(1/2)*\mu(W/L)Cox(Vgs-Vth)^2 \quad (1)$$

In the above equation, notation W denotes the width of the channel of the device driving transistor 22, notation L denotes the length of the channel, notation Cox denotes a gate capacitance per unit area.

Figure 7:
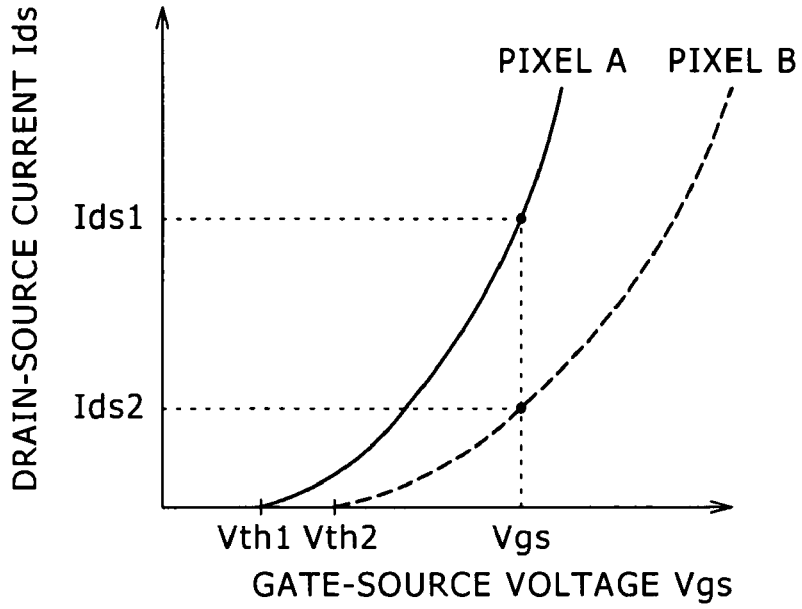
FIG. 7 is a characteristic diagram showing curves used for explaining variations in threshold voltage Vth of a device driving transistor from transistor to transistor.

FIG. 7 is a characteristic diagram showing curves each representing a current-voltage characteristic expressing a relation between the drain-source current Ids flowing between the drain and source electrodes of the device driving transistor 22 and the gate-source voltage Vgs applied between the gate and source electrodes of the device driving transistor 22.

A solid line in the characteristic diagram of FIG. 7 represents a characteristic for pixel circuit A having a device driving transistor 22 with a threshold voltage Vth1 whereas a dashed line in the same characteristic diagram represents a characteristic for pixel circuit B having a device driving transistor 22 with a threshold voltage Vth2 different from the threshold voltage Vth1.

In the example shown in the characteristic diagram of FIG. 7, the threshold voltage Vth2 of the device driving transistor 22 employed in pixel circuit B is greater than the threshold voltage Vth1 of the device driving transistor 22 employed in pixel circuit A, that is, Vth2>Vth1. In this case, for the same gate-source voltage Vgs on the horizontal axis, the drain-source current Ids flowing between the drain and source electrodes of the device driving transistor 22 employed in pixel circuit A is Ids1 whereas the drain-source current Ids flowing between the drain and source electrodes of the device driving transistor 22 employed in pixel circuit B is Ids2 which smaller than the drain-source current Ids1, that is, Ids2<Ids1. That is to say, even for the same gate-source voltage Vgs on the horizontal axis, if the threshold voltage Vth of the device driving transistor 22 varies from pixel to pixel, unless a threshold-voltage correction process is carried out to correct the drain-source current Ids for variations in Vth from pixel to pixel where notation Vth denotes the threshold voltage of the device driving transistor 22, the drain-source current Ids flowing between the drain and source electrodes of the drain-source current also varies from pixel to pixel as well.

In the pixel circuit 20 having the configuration described above, on the other hand, the gate-source voltage Vgs applied between the gate and source electrodes of the device driving transistor 22 at a light emission time is equal to (Vsig−Vofs+Vth−ΔV) as described before. By substituting the expression (Vsig−Vofs+Vth−ΔV) into Eq. (1) for Vgs, the drain-source current Ids can be expressed by Eq. (2) as follows:

$$Ids=(1/2)*\mu(W/L)Cox(Vsig-Vofs-\Delta V)^2 \quad (2)$$

That is to say, the term Vth representing the threshold voltage of the device driving transistor 22 is cancelled. In other words, the drain-source current Ids flowing from the device driving transistor 22 to the organic EL device 21 is no longer dependent on the threshold voltage Vth of the device driving transistor 22. As a result, even if the threshold voltage Vth of the device driving transistor 22 varies from pixel to pixel due to variations in process of manufacturing the device driving transistor 22 or due to the time degradation, the drain-source current Ids does not vary from pixel to pixel. Thus, it is possible to sustain the luminance of light emitted by each of organic EL devices 21 if the same gate-source voltage Vgs representing the same video-signal voltage Vsig is applied to the gate electrodes of the device driving transistors 22 employed in the pixel circuits each including one of the organic EL devices 21.

Principle of the Mobility Correction Process

Figure 8:
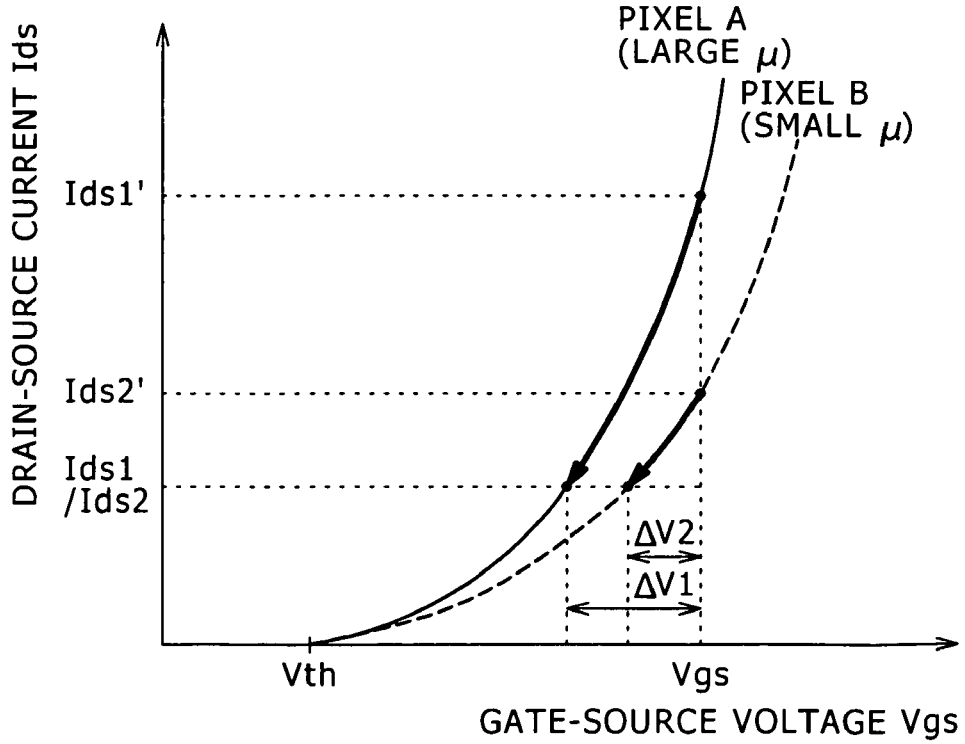
FIG. 8 is a characteristic diagram showing curves used for explaining variations in mobility μ of a device driving transistor from transistor to transistor.

The following description explains the principle of the mobility correction process. FIG. 8 is also a characteristic diagram showing curves each representing a current-voltage characteristic expressing a relation between the drain-source current Ids flowing between the drain and source electrodes of the device driving transistor 22 and the gate-source voltage Vgs applied between the gate and source electrodes of the device driving transistor 22. A solid line in the characteristic diagram of FIG. 8 represents a characteristic for pixel circuit A having a device driving transistor 22 with a relatively large mobility μ whereas a dashed line in the same characteristic diagram represents a characteristic for pixel circuit B having a device driving transistor 22 with a relatively small mobility μ. If a poly-silicon thin film transistor or the like is employed in the pixel circuit 20 as the device driving transistor 22, variations in mobility μ from pixel to pixel such as the differences in mobility μ between pixel circuits A and B cannot be avoided.

With the existing differences in mobility μ between pixel circuits A and B, even if the same gate-source voltage Vgs representing the same video-signal voltage Vsig is applied to the gate electrodes of the device driving transistors 22 employed in pixel circuit A employing a device driving transistor 22 with a relatively large mobility μ and pixel circuit B employing a device driving transistor 22 with a relatively small mobility μ, the drain-source current Ids flowing between the drain and source electrodes of the device driving transistor 22 employed in pixel circuit A is Ids1' whereas the drain-source current Ids flowing between the drain and source electrodes of the device driving transistor 22 employed in pixel circuit B is Ids2' much different from the drain-source current Ids1' unless a mobility correction process is carried out to correct the drain-source current Ids flowing between the drain and source electrodes of the device driving transistor 22 for the differences in mobility μ between pixel circuits A and B. If such a large Ids difference is caused by variations in p from pixel to pixel as a difference in drain-source current Ids between the device driving transistors 22 where notation p denotes the mobility of the device driving transistor 22, the uniformity of the screen is lost.

As is obvious from Eq. (1) given earlier as an equation expressing the characteristic of the device driving transistor 22, the larger the mobility μ of a device driving transistor 22, the larger the drain-source current Ids flowing between the drain and source electrodes of the device driving transistor 22. Thus, the larger the mobility μ of a device driving transistor 22, the larger the feedback quantity ΔV of the negative feedback operation. As shown in the characteristic diagram of FIG. 8, the feedback quantity ΔV1 of pixel circuit A employing a device driving transistor 22 with a relatively large mobility μ is greater than the feedback quantity ΔV2 of pixel circuit B employing a device driving transistor 22 with a relatively small mobility μ.

The mobility correction process is carried out by negatively feeding the drain-source current Ids flowing between the drain and source electrodes of the device driving transistor 22 back to the Vsig side where notation Vsig denotes the voltage of the video signal. In this negative feedback operation, the larger the mobility μ of a device driving transistor 22, the higher the degree at which the negative feedback operation is carried out. As a result, it is possible to eliminate the variations in μ from pixel to pixel where notation p denotes the mobility of the device driving transistor 22.

To put it concretely, if the feedback quantity ΔV1 is taken in the negative feedback operation of the mobility correction process carried out on pixel circuit A employing a device driving transistor 22 with a relatively large mobility μ, the drain-source current Ids flowing between the drain and source electrodes of the device driving transistor 22 employed in pixel circuit A is greatly reduced from Ids1' to Ids1. If the feedback quantity ΔV2 smaller than the feedback quantity ΔV1 is taken in the negative feedback operation of the mobility correction process carried out on pixel circuit B employing a device driving transistor 22 with a relatively small mobility μ, on the other hand, in comparison with pixel circuit A, the drain-source current Ids flowing between the drain and source electrodes of the device driving transistor 22 employed in pixel circuit B is slightly reduced from Ids2' to Ids2 which is all but equal to the drain-source current Ids1. As a result, since Ids1 representing the drain-source current Ids flowing between the drain and source electrodes of the device driving transistor 22 employed in pixel circuit A is all but equal to Ids2 representing the drain-source current Ids flowing between the drain and source electrodes of the device driving transistor 22 employed in pixel circuit B, it is possible to correct the drain-source current Ids flowing between the drain and source electrodes of the device driving transistor 22 for variations of the mobility of the device driving transistor 22 from pixel to pixel.

What is described above is summarized as follows. The feedback quantity ΔV1 taken in the negative feedback operation carried out as the mobility correction process on pixel circuit A employing a device driving transistor 22 with a relatively large mobility μ is large in comparison with the feedback quantity ΔV2 taken in the negative feedback operation of the mobility correction process carried out on pixel circuit B employing a device driving transistor 22 with a relatively small mobility μ. That is to say, the larger the mobility μ of a device driving transistor 22, the larger the feedback quantity ΔV of the negative feedback operation carried out on a pixel circuit employing the device driving transistor 22 and, hence, the larger the decrease in drain-source current Ids flowing between the drain and source electrodes of the device driving transistor 22.

Thus, by negatively feeding the drain-source current Ids flowing between the drain and source electrodes of the device driving transistor 22 back to the gate-electrode side supplied with the video-signal voltage Vsig as the gate-electrode side of the device driving transistor 22, the magnitudes of the drain-source currents Ids following through device driving transistors 22 employed in pixel circuits as device driving transistors 22 having different values of the mobility μ can be averaged. As a result, it is possible to correct the drain-source current Ids flowing between the drain and source electrodes of the device driving transistor 22 for variations of the mobility of the device driving transistor 22 from pixel to pixel. That is to say, the negative-feedback operation of negatively feeding the magnitude of the drain-source current Ids flowing between the drain and source electrodes of the device driving transistor 22 back to the gate-electrode side of the device driving transistor 22 is the mobility correction process.

FIG. 9 is a plurality of diagrams each showing relations between the video-signal voltage Vsig (or the sampling electric potential) and the drain-source current Ids flowing between the drain and source electrodes of the device driving transistor 22 employed in the pixel circuit 20 included in the active-matrix organic EL display apparatus 10 shown in the block diagram of FIG. 2. The diagrams show such relations for a variety of driving methods carried out with or without the threshold-voltage correction process and with or without the mobility correction process.

Figure 9A:
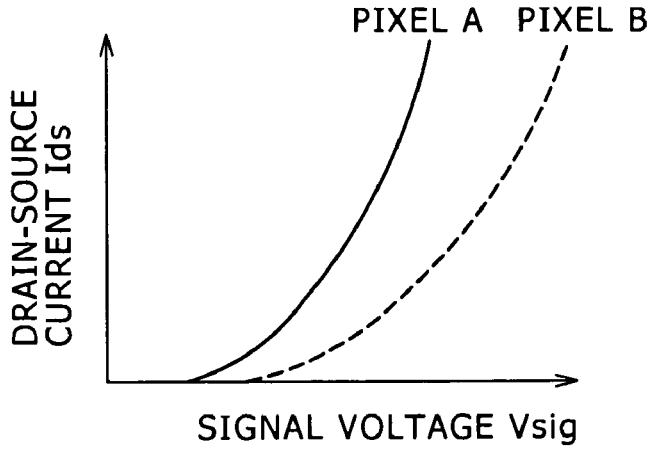
FIGS. 9A to 9C are a plurality of diagrams each showing relations between a video-signal voltage Vsig and a drain-source current Ids flowing between the drain and source electrodes of a device driving transistor for a variety of cases.
Figure 9B:
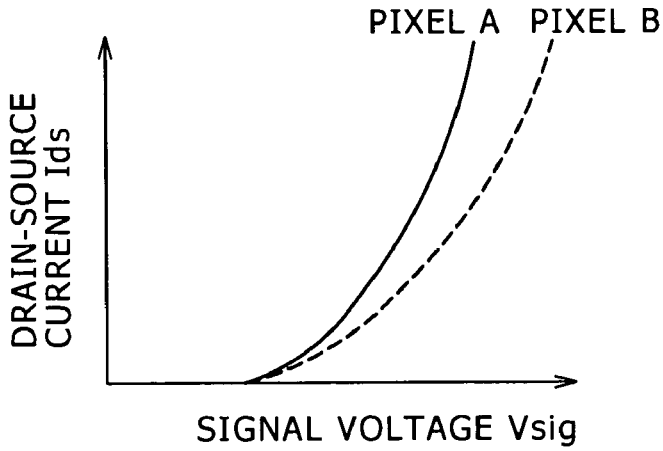
Figure 9C:
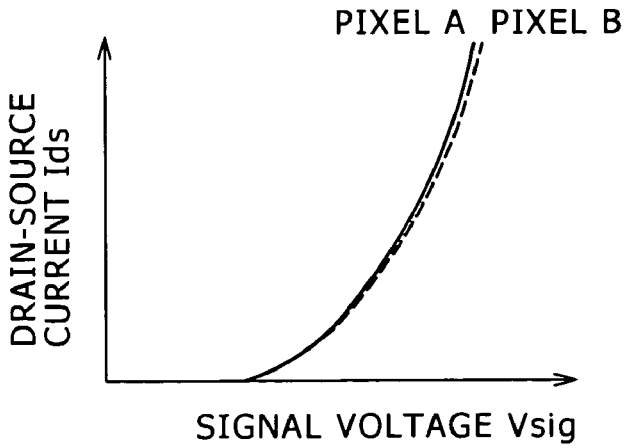

To be more specific, in FIG. 9A, different pixel circuits A and B are subjected to neither the threshold-voltage correction process nor the mobility correction process. In FIG. 9B, different pixel circuits A and B are subjected to the threshold-voltage correction process but not subjected to the mobility correction process. In FIG. 9C, different pixel circuits A and B are subjected to both the threshold-voltage correction process and the mobility correction process. As shown by the curves of FIG. 9A given for a case in which pixel circuits A and B are subjected to neither the threshold-voltage correction process nor the mobility correction process, for the same video-signal voltage Vsig on the horizontal axis, a big difference in drain-source current Ids between pixel circuits A and B having different threshold voltages Vth and different values of the mobility μ is observed as a difference caused by the different threshold voltages Vth and the different values of the mobility μ.

As shown by the curves of FIG. 9B given for a case in which pixel circuits A and B are subjected to the threshold-voltage correction process but not subjected to the mobility correction process, on the other hand, for the same video-signal voltage Vsig on the horizontal axis, a smaller difference in drain-source current Ids between pixel circuits A and B having different threshold voltages Vth and different values of the mobility μ is observed as a difference caused by the different threshold voltages Vth and the different values of the mobility μ. Even though the difference is reduced to a certain degree from the difference for the case shown by the curves of FIG. 9A, the difference caused by the different values of the mobility μ still remains.

As shown by the curves of FIG. 9C given for a case in which pixel circuits A and B are subjected to both the threshold-voltage correction process and the mobility correction process, for the same video-signal voltage Vsig on the horizontal axis, all but no difference in drain-source current Ids between pixel circuits A and B having different threshold voltages Vth and different values of the mobility μ is observed as a difference caused by the different threshold voltages Vth and the different values of the mobility μ. Thus, there are no variations of the luminance of light emitted by the organic EL device 21 from pixel to pixel for every gradation. As a result, it is possible to display an image having a high quality.

In addition, besides the threshold-voltage and mobility correction functions, the pixel circuit 20 included in the active-matrix organic EL display apparatus 10 shown in the block diagram of FIG. 2 also has a bootstrap-operation function of the storage capacitor 24 as described previously so that the pixel circuit 20 is capable of exhibiting an effect described as follows.

Even if the source electric potential Vs appearing on the source electrode of the device driving transistor 22 changes because the I-V characteristic of the organic EL device 21 deteriorates with the lapse of time in a time degradation process, the bootstrap operation of the storage capacitor 24 allows the gate-source voltage Vgs applied between the gate and source electrodes of the device driving transistor 22 to be sustained at a fixed level so that the current flowing through the organic EL device 21 also does not change with the lapse of time in a time degradation process. Thus, since the luminance of light emitted by the organic EL device 21 also does not vary with the lapse of time in a time degradation process, it is possible to display images with no deteriorations accompanying the time degradation of the I-V characteristic of the organic EL device 21 even if the I-V characteristic worsens with the lapse of time in a time degradation process.

Problems in an Actual Operating State

Figure 10:
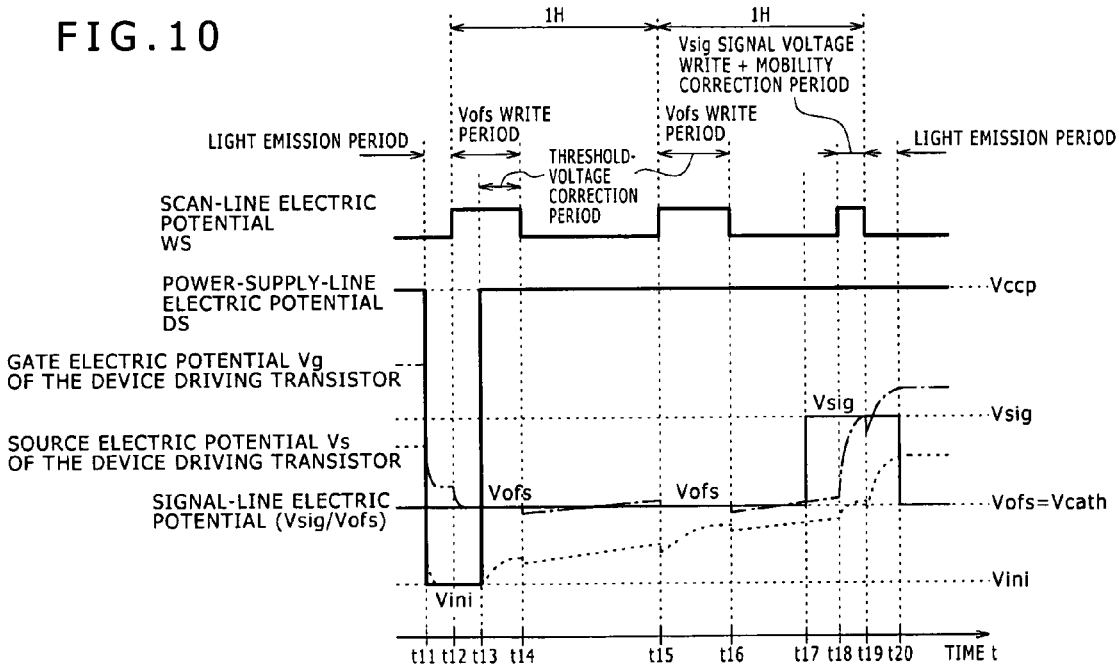
FIG. 10 is a timing/waveform diagram to be referred to in description of actual operations carried out by an active-matrix organic EL display apparatus to which an embodiment of the present invention is applied.

Next, circuit operations in an actual operating state of the organic EL display apparatus 10 are explained by referring to a timing/waveform diagram of FIG. 10.

It is to be noted that, in the circuit operations described below as circuit operations in an actual operating state of the organic EL display apparatus 10, after an electric potential appearing on the gate electrode of the device driving transistor 22 has been initialized at an initialization electric potential equal to the reference electric potential Vofs in an operation carried out by the signal writing transistor 23 to store the reference electric potential Vofs into the storage capacitor 24 connected to the gate electrode of the device driving transistor 22, a threshold-voltage correction process is carried out to change an electric potential appearing on the source electrode of the device driving transistor 22 toward an electric-potential level obtained by subtracting the threshold voltage of the device driving transistor 22 from the reference electric potential Vofs which is the initialization electric potential of the gate electrode of the device driving transistor 22. The threshold-voltage correction process is carried out prior to a mobility correction process and a signal write process which are executed in a specific 1H horizontal scan period including a period of the threshold-voltage correction process. Prior to the specific 1H horizontal scan period, the threshold-voltage correction process is also carried out additionally a plurality of times distributed among the same plurality of 1H horizontal scan periods leading ahead of the mobility correction process and the signal write process. In the case of this embodiment, the threshold-voltage correction process is carried out a total of two times distributed in two 1H horizontal scan periods. That is to say, the threshold-voltage correction process is carried out once in the specific 1H horizontal scan period and once in a 1H horizontal scan period immediately leading ahead of the specific 1H horizontal scan period. In the following description, the threshold-voltage correction process carried out a plurality of times distributed among the same plurality of 1H horizontal scan periods is also referred to as distributed Vth correction processing.

To put it concretely, in the case of a threshold-voltage correction process carried out two times distributed in 2H, that is, two 1H horizontal scan periods, as shown in the timing/waveform diagram of FIG. 10, the threshold-voltage correction process is carried out once between times t12 to t14 in a 1H horizontal scan period immediately leading ahead of the specific 1H horizontal scan period including the mobility correction process as well as the signal write process and once between times t15 to t16 in the specific 1H horizontal scan period.

In this way, the specific 1H horizontal scan period, which includes the mobility correction process and the signal write process, as well as the 1H horizontal scan period immediately leading ahead of the specific 1H horizontal scan period are allocated to the distributed Vth correction processing as threshold-voltage correction periods and then the threshold-voltage correction process is carried out as many times as the threshold-voltage correction periods. Thus, sufficient time can be assured as each of the threshold-voltage correction periods allocated to the distributed Vth correction processing even if the length of the 1H scan period including a threshold-voltage correction period becomes shorter due to a larger pixel-circuit count accompanying higher definition of the display screen. As a result, the threshold voltage Vth of the device driving transistor 22 can be detected with a high degree of reliability and stored in the storage capacitor 24 so that the threshold-voltage correction process can also be carried out reliably.

From the circuit-operation point of view, times t11, t13 and t17 to t20 shown in the timing/waveform diagram of FIG. 10 correspond respectively to the times t1, t3 and t5 to t8 shown in the timing/waveform diagram of FIG. 4. Each of times t12 and t15 shown in the timing/waveform diagram of FIG. 10 corresponds to the time t2 shown in the timing/waveform diagram of FIG. 4 whereas each of times t14 and t16 shown in the timing/waveform diagram of FIG. 10 corresponds to the time t4 shown in the timing/waveform diagram of FIG. 4.

By the way, in the ideal operating state described previously, at the time t4, the electric potential appearing on the scan line 31 as a write pulse WS changes to a level on the low electric-potential side, putting the signal writing transistor 23 in a non-conductive state. When the signal writing transistor 23 is put in a non-conductive state, the gate electrode of the device driving transistor 22 is electrically disconnected from the signal line 33 and put in a floating state. Since the voltage Vgs appearing between the gate and source electrodes of the device driving transistor 22 is equal to the threshold voltage Vth of the device driving transistor 22, however, the device driving transistor 22 is put in a cut-off state, not allowing the current Ids to flow between the drain and source electrodes of the device driving transistor 22.

However, what is described above is no more than the ideal state which has been explained earlier. In an actual operation, in the same way as the ideal state, at each of a time t14 coinciding with the end of the first threshold-voltage correction process and a time t16 coinciding with the end of the second threshold-voltage correction process, the electric potential appearing on the scan line 31 as a write pulse WS changes to a level on the low electric-potential side, putting the signal writing transistor 23 in a non-conductive state.

When the signal writing transistor 23 is put in a non-conductive state, the gate electrode of the device driving transistor 22 is electrically disconnected from the signal line and put in a floating state. In this floating state of the actual operation, however, a leak current is flowing through the device driving transistor 22 even though the magnitude of the leak current is small. The leak current causes an electric potential Vs appearing on the source electrode of the device driving transistor 22 to rise gradually and, due to a bootstrap operation, the gradually rising electric potential Vs appearing on the source electrode of the device driving transistor 22 causes an electric potential Vg appearing on the gate electrode of the device driving transistor 22 to also increase gradually.

In addition, the characteristic of the device driving transistor 22 employed in the pixel circuit 20 also varies from pixel to pixel so that the leak current flowing through the device driving transistor 22 varies from pixel to pixel as well. Thus, the increase of the electric potential Vs appearing on the source electrode of the device driving transistor 22 employed in the pixel circuit 20 and the increase of the electric potential Vg appearing on the gate electrode of the same device driving transistor 22 also vary from pixel to pixel as well.

After the end of a threshold-voltage correction process, the leak current causes the electric potential Vg appearing on the gate electrode of the device driving transistor 22 to increase in a manner of being interlocked with the electric potential Vs appearing on the source electrode of the same device driving transistor 22. Thus, there is concern that the pixel circuit 20 raises a problem of impossibility to store a video signal Vsig normally in a process to store the voltage of the video signal Vsig into the storage capacitor 24 after the threshold-voltage correction process, particularly, in a process to store a low voltage of the video signal Vsig into the storage capacitor 24 after the threshold-voltage correction process because the electric potential Vg appearing on the gate electrode of the device driving transistor 22 has risen to a level which is too high for (or even higher than) the voltage of the video signal Vsig to be written into the storage capacitor 24.

In addition, in the course of execution of the distributed Vth correction processing and, in particular, at the initial stage of the distributed Vth correction processing, as is obvious from the timing/waveform diagram of FIG. 10, after an electric potential Vg appearing on the gate electrode of the device driving transistor 22 has been initialized at an initialization electric potential equal to the reference electric potential in an operation carried out by the signal writing transistor 23 to store the reference electric potential Vofs into the storage capacitor 24 connected to the gate electrode of the device driving transistor 22, an electric potential Vs appearing on the source electrode of the device driving transistor 22 is changing toward an electric-potential level obtained by subtracting the threshold voltage Vth of the device driving transistor 22 from the reference electric potential Vofs which is the initialization electric potential of the gate electrode of the device driving transistor 22. Thus, at that time, the difference between the threshold voltage Vth of the device driving transistor 22 and the gate-source voltage Vgs of the device driving transistor 22 is large.

If the bootstrap operation cited above is carried out with the voltage Vgs between the gate and source electrodes of the device driving transistor 22 not converged to the threshold voltage Vth of the device driving transistor 22 as described above, the threshold-voltage correction process cannot be carried out with a high degree of reliability as a process for eliminating the effect of variations of the threshold voltage Vth of the device driving transistor 22 from pixel to pixel. That is to say, the variations of the threshold voltage Vth of the device driving transistor 22 from pixel to pixel can be said to undesirably remain uncorrected for. As a result, the threshold-voltage correction process is not capable of sufficiently demonstrating an effect of improving the display quality.

Characteristics of the Embodiment

In the embodiment, in operations carried out by the write scan circuit 40 to supply write pulses WS to the gate electrode of the signal writing transistor 23 through a scan line 31 as write pulses WS for the reference electric potential Vofs and the video-signal voltage Vsig which are supplied by the signal outputting circuit 60 to the source electrode of the signal writing transistor 23 through a signal line 33, the write scan circuit 40 supplies the write pulse WS to the gate electrode of the signal writing transistor 23 when the signal outputting circuit 60 is outputting the reference electric potential to the source electrode of the signal writing transistor 23 as a write pulse WS having a waveform height greater than the waveform height of a write pulse WS supplied by the write scan circuit 40 to the gate electrode of the signal writing transistor 23 when the signal outputting circuit 60 is outputting the video signal voltage Vsig to the source electrode of the signal writing transistor 23.

When the write pulse WS applied to the gate electrode of the signal writing transistor 23 is changed from a high level typically representing an active state to a low level typically representing an inactive state, the abrupt change of the write pulse WS is passed on to the gate electrode of the device driving transistor 22 through the drain electrode of the signal writing transistor 23 due to a coupling effect exhibited by a parasitic capacitor C, which exists between the gate and drain electrodes of the signal writing transistor 23 as shown in the block diagram of FIG. 2, so that an electric potential Vg appearing on the gate electrode of the device driving transistor 22 also changes as well. In the case of this embodiment, the electric potential Vg appearing on the gate electrode of the device driving transistor 22 decreases due to the capacitive coupling effect in the transition of the write pulse WS from a high level to a low level.

By the same token, the write pulse WS applied to the gate electrode of the signal writing transistor 23 is also changed from a high level to a low level at the end of a signal write process carried out to store the video signal voltage Vsig asserted by the signal outputting circuit 60 on the signal line 33 into the storage capacitor 24 after the threshold-voltage correction process so that the electric potential Vg appearing on the gate electrode of the device driving transistor 22 also changes at the end of the signal write process due to the same capacitive coupling effect. As described earlier, however, the write pulse WS applied to the gate electrode of the signal writing transistor 23 in a threshold-voltage correction process carried out to store the reference electric potential Vofs into the storage capacitor 24 has a waveform height greater than the waveform height of the write pulse WS applied to the gate electrode of the signal writing transistor 23 in the signal write process, that is, greater than the waveform height of the write pulse WS applied to the gate electrode of the signal writing transistor 23 in an actual operating state shown in the timing/waveform diagram shown in FIG. 10. Thus, the change observed at the end of the threshold-voltage correction process carried out to store the reference electric potential Vofs into the storage capacitor 24 as the change of the electric potential Vg appearing on the gate electrode of the device driving transistor 22 is greater than the corresponding change observed in the actual operating state shown in the timing/waveform diagram shown in FIG. 10. As a result, a voltage Vgs appearing between the gate and source electrodes of the device driving transistor 22 at the end of the threshold-voltage correction process decreases, putting the device driving transistor 22 in a cut-off state so that no leak current mentioned before flows through the device driving transistor 22. With the leak current prevented from flowing through the device driving transistor 22, during the period of a floating state of the gate electrode of the signal writing transistor 23, the electric potential Vg appearing on the gate electrode of the device driving transistor 22 is also prevented from rising to a level which is too high for (or even higher than) the voltage Vsig of a video signal to be stored into the storage capacitor 24.

Figure 11:
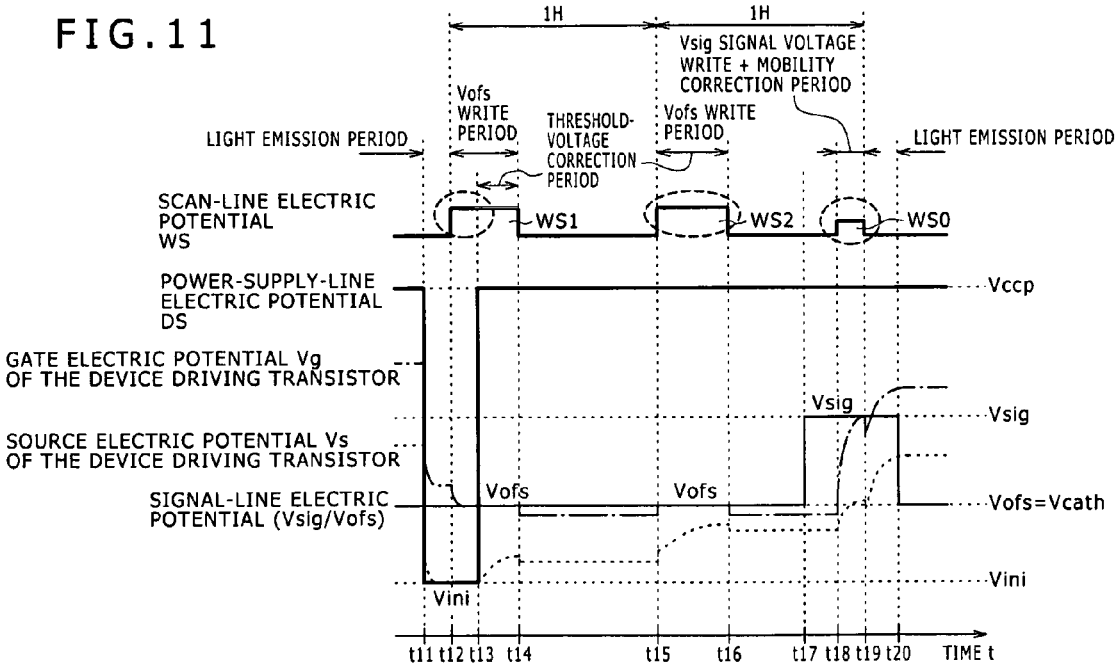
FIG. 11 is a timing/waveform diagram of signals in typical distributed Vth correction processing carried out by an active-matrix organic EL display apparatus according to an embodiment of the present invention.

As an example, FIG. 11 is given as a timing/waveform diagram of signals in typical distributed Vth correction processing. Much like the circuit operations carried out in the actual operating state explained earlier by referring to the timing/waveform diagram of FIG. 10, a threshold-voltage correction process is carried out prior to a mobility correction process and a signal write process which are executed in a specific 1H horizontal scan period including a period of the threshold-voltage correction process. Prior to the specific 1H horizontal scan period, the threshold-voltage correction process is also carried out once in a 1H horizontal scan period leading ahead of the mobility correction process and the signal write process. That is to say, the threshold-voltage correction process is carried out two times distributed in two 1H horizontal scan periods. To be more specific, the threshold-voltage correction process is carried out once in the specific 1H horizontal scan period and once in a 1H horizontal scan period immediately leading ahead of the specific 1H horizontal scan period. Thus, the threshold-voltage correction process is carried out a total of two times distributed in 2H, that is, two 1H horizontal scan periods, as distributed Vth correction processing. The timings of this distributed Vth correction processing are the same as those of the circuit operations carried out in the actual operating state explained earlier by referring to the timing/waveform diagram of FIG. 10.

In operations to store the reference electric potential Vofs from the signal line 33 to the storage capacitor 24 connected to the gate electrode of the device driving transistor 22 by way of the signal writing transistor 23 during the two threshold-voltage correction processes, as shown in the timing/waveform diagram of FIG. 11, the write scan circuit 40 sets the waveform height of write pulses WS1 and WS2 each asserted on the scan line 31 as an electric potential of a high level representing an active state at a value greater than the waveform height of a write pulse WS0 asserted on the scan line 31 as an electric potential of a high level representing an active state in an operation to store a video-signal voltage Vsig from the signal line 33 to the storage capacitor 24 by way of the signal writing transistor 23 during a signal write process.

By setting the waveform height of the write pulses WS1 and WS2 used in the operations to store the reference electric potential Vofs into the storage capacitor 24 connected to the gate electrode of the device driving transistor 22 at a value greater than the waveform height of a write pulse WS0 used in the operation to store a video-signal voltage Vsig into the storage capacitor 24 as described above, the following effects can be obtained.

At a time t14 coinciding with the end of the first threshold-voltage correction process, the write pulse WS1 is changed from a high level to a low level. This abrupt change of the write pulse WS1 is passed on to the gate electrode of the device driving transistor 22 through the drain electrode of the signal writing transistor 23 due to a coupling effect exhibited by a parasitic capacitor C, which exists between the gate and drain electrodes of the signal writing transistor 23 as shown in the block diagram of FIG. 2. By the same token, at a time t16 coinciding with the end of the second threshold-voltage correction process, the write pulse WS2 is changed from a high level to a low level and this abrupt change of the write pulse WS2 is passed on to the gate electrode of the device driving transistor 22. In the same way, at a time t19 coinciding with the end of the signal write process, the write pulse WS0 is changed from a high level to a low level and this abrupt change of the write pulse WS0 is passed on to the gate electrode of the device driving transistor 22. Since the waveform height of the write pulses WS1 and WS2 are greater than the waveform height of the write pulse WS0, however, the abrupt changes of the write pulses WS1 and WS2 are greater than the abrupt change of the write pulses WS0.

At the times t14 and t16 shown in the timing/waveform diagram of FIG. 11, these greater abrupt changes of the write pulses WS1 and WS2 more lower the electric potential Vg appearing on the gate electrode of the device driving transistor 22 and, thus, decrease the voltage Vgs appearing between the gate and source electrodes of the device driving transistor 22, putting the device driving transistor 22 in a cut-off state so that no leak current mentioned before flows through the device driving transistor 22.

Since no leak current flows through the device driving transistor 22, an electric potential Vs appearing on the source electrode of the device driving transistor 22 does not rise, but is sustained at a fixed level instead. Thus, when the signal writing transistor 23 is put in a non-conductive state, electrically disconnecting the gate electrode of the device driving transistor 22 from the signal line 33 so that the gate electrode of the device driving transistor 22 is put in a floating state, an electric potential Vg appearing on the gate electrode of the device driving transistor 22 is also sustained at a fixed level in a state of being interlocked with the electric potential Vs appearing on the source electrode of the device driving transistor 22. As a result, it is possible to prevent the electric potential Vg appearing on the gate electrode of the device driving transistor 22 from rising during a period in which the electric potential Vg appearing on the gate electrode of the device driving transistor 22 is in a floating state.

As described above, it is possible to prevent the electric potential Vg appearing on the gate electrode of the device driving transistor 22 from rising due to a leak current flowing through the device driving transistor 22 during a period in which the electric potential Vg appearing on the gate electrode of the device driving transistor 22 is in a floating state. Thus, it is possible to avoid a situation in which a video-signal voltage Vsig to be written into the storage capacitor 24 is lower than the electric potential Vg appearing on the gate electrode of the device driving transistor 22 in a signal write process to store a particularly low video-signal voltage Vsig into the storage capacitor 24 by making use of the write pulse WS0. As a result, the signal write process to store a video-signal voltage Vsig into the storage capacitor 24 and the mobility correction process can be carried out normally so that the display quality can be improved.

In particular, if the bootstrap operation cited above is carried out with the voltage Vgs between the gate and source electrodes of the device driving transistor 22 not converged to the threshold voltage Vth of the device driving transistor 22 as described above, the threshold-voltage correction process cannot be carried out with a high degree of reliability as a process for eliminating the effect of variations of the threshold voltage Vth of the device driving transistor 22 from pixel to pixel. That is to say, the variations of the threshold voltage Vth of the device driving transistor 22 from pixel to pixel can be said to undesirably remain uncorrected for. As a result, the desired threshold-voltage correction process cannot be carried out.

In the case of this embodiment, on the other hand, it is possible to prevent the electric potential Vg appearing on the gate electrode of the device driving transistor 22 from rising due to a leak current flowing through the device driving transistor 22 during a period in which the electric potential Vg appearing on the gate electrode of the device driving transistor 22 is in a floating state so that it is possible to reliably carry out a threshold-voltage correction process for eliminating the effect of variations of the threshold voltage Vth of the device driving transistor 22 from pixel to pixel. Thus, since the threshold-voltage correction process makes it possible to obtain an adequate display-quality improvement effect, the display quality can be further improved.

As described above, on the falling edge of the write pulse WS0 at the end of a signal write process carried out to store the video signal voltage Vsig into the storage capacitor 24, the electric potential Vg appearing on the gate electrode of the device driving transistor 22 also drops slightly due to a capacitive coupling effect. However, the waveform height of the write pulse WS0 is set at such a value that the decrease in gate electric potential Vg is suppressed to a magnitude which does not have an effect on a light emission operation following the signal write process.

The waveform height of the write pulse WS0 is determined by taking parameters such as the capacitance of the parasitic capacitor C into consideration. Then, the determined waveform height of the write pulse WS0 is used as a reference in determining the waveform heights of the write pulses WS1 and WS2. To put it detail, by taking parameters such as the capacitance of the parasitic capacitor C into consideration, each of the waveform heights of the write pulses WS1 and WS2 is set at a value greater than the waveform height of the write pulse WS0. In this embodiment, as an example, the waveform height of the write pulse WS1 is set at a value equal to a value at which the waveform height of the write pulse WS2 is set.

By the way, the waveform height of the last write pulse WS2 (that is, the second write pulse in the case of this embodiment) in the distributed Vth correction processing is set at a value greater than the waveform height of the write pulse WS0 used in a signal write process carried out to store the video signal voltage Vsig into the storage capacitor 24. As described above, on the falling edge of the write pulse WS0 at the end of a signal write process carried out to store the video signal voltage Vsig into the storage capacitor 24, the electric potential Vg appearing on the gate electrode of the device driving transistor 22 also drops a little bit due to a capacitive coupling effect. After the electric potential Vg appearing on the gate electrode of the device driving transistor 22 drops, the video signal voltage Vsig is written over the dropped electric potential Vg so that the voltage amplitude in the signal write process carried out by the signal writing transistor 23 to store the video signal voltage Vsig into the storage capacitor 24 increases by an increment equal to the decrease in electric potential Vg.

When the voltage amplitude in the signal write process carried out by the signal writing transistor 23 to store the video signal voltage Vsig into the storage capacitor 24 increases, it takes longer time to complete the signal write process. By the way, a mobility correction process is carried out automatically at the same time as the signal write process. If it takes longer time to complete the signal write process, the mobility correction process is carried out for excessively long time so that the mobility correction process is carried out more than required before the signal write process is completed. That is to say, the luminance of light emitted by the organic EL device 21 is undesirably over corrected for variations of the mobility of the device driving transistor 22 from pixel to pixel. It is thus necessary to carry out the signal write process itself to store the video signal voltage Vsig into the storage capacitor 24 at as high a speed as possible.

First Modified Version of the Distributed Vth Correction Processing

Figure 12A:
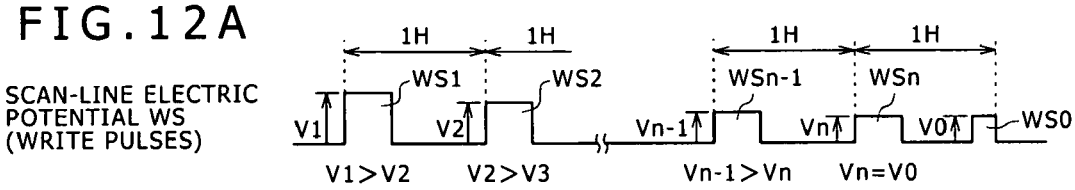
FIGS. 12A and 12B are a plurality of timing/waveform diagrams of write pulses WS generated in modified versions of the distributed Vth correction processing.

In the case of a first modified version of the distributed Vth correction processing, as the distributed Vth correction processing is carried forward by sequential execution of the first threshold-voltage correction process, the second threshold-voltage correction process, . . . and the nth threshold-voltage correction process as shown in a timing/waveform diagram of FIG. 12A, that is, as the number assigned to the executed threshold-voltage correction process increases with the progress of the execution of the distributed Vth correction processing, the waveform heights V1, V2, . . . and Vn of respectively the write pulses WS1, WS2, . . . and WSn each used in an operation carried out to store the reference electric potential Vofs into the storage capacitor 24 are gradually decreased toward the waveform height V0 of the write pulse WS0 used in a signal write process carried out to store the video-signal voltage Vsig into the storage capacitor 24. To put it concretely, the waveform heights V1, V2, . . . Vn and V0 satisfy the following relations: V1>V2> . . . >Vn and Vn=V0.

As described above, as the number assigned to the executed threshold-voltage correction process increases with the progress of the execution of the distributed Vth correction processing, the waveform heights V1, V2, . . . and Vn of respectively the write pulses WS1, WS2, . . . and WSn each used in an operation carried out to store the reference electric potential Vofs into the storage capacitor 24 during one of the periods of the first threshold-voltage correction process, the second threshold-voltage correction process, . . . and the nth threshold-voltage correction process are gradually decreased toward the waveform height V0 of the write pulse WS0 used in a signal write process carried out to store the video-signal voltage Vsig into the storage capacitor 24. Thus, a decrease caused by the capacitive coupling effect occurring on each of the falling edges of the write pulses WS1, WS2, . . . and WSn each used in an operation carried out to store the reference electric potential Vofs into the storage capacitor 24 as the decrease of the electric potential Vg appearing on the gate electrode of the device driving transistor 22 is also gradually reduced toward a level approximately equal to a decrease caused by the capacitive coupling effect occurring on the falling edge of the write pulse WS0 used in the signal write process carried out to store the video-signal voltage Vsig into the storage capacitor 24. As a result, it is possible to prevent the voltage amplitude in the signal write process carried out by the signal writing transistor 23 to store the video signal voltage Vsig into the storage capacitor 24 from increasing and, hence, possible to carry out the signal write process to store the video signal voltage Vsig into the storage capacitor 24 at a high speed. Accordingly, the signal write process to store the video signal voltage Vsig into the storage capacitor 24 and the mobility correction process can be carried out in a more stable manner.

Second Modified Version of the Distributed Vth Correction Processing

Figure 12B:
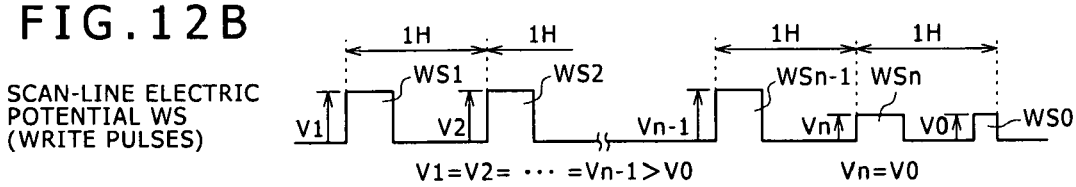

In the case of a second modified version of the distributed Vth correction processing, on the other hand, when the distributed Vth correction processing is carried forward by sequential execution of the first threshold-voltage correction process, the second threshold-voltage correction process, . . .

and the (n−1)th threshold-voltage correction process as shown in a timing/waveform diagram of FIG. 12B, that is, when the number assigned to the executed threshold-voltage correction process increases with the progress of the execution of the distributed Vth correction processing, all of the waveform heights V1, V2, . . . and Vn−1 of respectively the write pulses WS1, WS2, . . . and WSn−1 each used in an operation carried out to store the reference electric potential Vofs into the storage capacitor 24 during one of the periods of the first threshold-voltage correction process, the second threshold-voltage correction process, . . . and the (n−1)th threshold-voltage correction process are kept at a constant level which is higher than the waveform height V0 of the write pulse WS0 used in a signal write process carried out to store the video-signal voltage Vsig into the storage capacitor 24. However, the waveform height Vn of the write pulse WSn used in an operation carried out to store the reference electric potential Vofs into the storage capacitor 24 during the period of the nth threshold-voltage correction process which is the last threshold-voltage correction process in the distributed Vth correction processing is reduced from the constant level to approximately the waveform height V0 of the write pulse WS0 used in a signal write process carried out to store the video-signal voltage Vsig into the storage capacitor 24. To put it concretely, the waveform heights V1, V2, . . . Vn and V0 satisfy the following relations: V1=V2= . . . =Vn−1>Vn=V0.

As described above, the waveform height Vn of the write pulse WSn used in an operation carried out to store the reference electric potential Vofs into the storage capacitor 24 during the period of the nth threshold-voltage correction process which is the last threshold-voltage correction process in the distributed Vth correction processing is reduced to approximately the waveform height V0 of the write pulse WS0 used in a signal write process carried out to store the video-signal voltage Vsig into the storage capacitor 24. Thus, a decrease caused by the capacitive coupling effect occurring on the falling edge of the write pulse WSn used in an operation carried out to store the reference electric potential Vofs into the storage capacitor 24 as the decrease of the electric potential Vg appearing on the gate electrode of the device driving transistor 22 is reduced toward a level approximately equal to a decrease caused by the capacitive coupling effect occurring on the falling edge of the write pulse WS0 used in a signal write process carried out to store the video-signal voltage Vsig into the storage capacitor 24. As a result, it is possible to prevent the voltage amplitude in the signal write process carried out by the signal writing transistor 23 to store the video signal voltage Vsig into the storage capacitor 24 from increasing and, hence, possible to carry out the signal write process to store the video signal voltage Vsig into the storage capacitor 24 at a high speed. Accordingly, the signal write process to store the video signal voltage Vsig into the storage capacitor 24 and the mobility correction process can be carried out in a more stable manner.

By setting each of the waveform heights V1, V2, . . . and Vn−1 of respectively the write pulses WS1, WS2, . . . and WSn−1 each used in an operation carried out to store the reference electric potential Vofs into the storage capacitor 24 during one of the periods of the first threshold-voltage correction process, the second threshold-voltage correction process, . . . and the (n−1)th threshold-voltage correction process respectively at a constant level which is higher than the waveform height Vn of the write pulse WSn used in an operation carried out to store the reference electric potential Vofs into the storage capacitor 24 during the period of the nth threshold-voltage correction process carried out as the last threshold-voltage correction process in the distributed Vth correction processing, it is necessary to prepare only two different waveform heights of the write pulse WS. On top of that, in comparison with the first modified version in which it is necessary to prepare a number of different waveform heights of the write pulse WS, the second modified version offers a merit of a simple circuit configuration of the write scan circuit 40.

As described above, in the circuit operations carried out in accordance with the embodiment, a plurality of threshold-voltage correction periods allocated to the distributed Vth correction processing for correcting the luminance of light emitted by the organic EL device 21 for variations of the threshold voltage Vth of the device driving transistor 22 from pixel to pixel are provided as a plurality of 1H horizontal scan periods each leading ahead a specific 1H scan period used for carrying out the last threshold-voltage correction process of the distributed Vth correction processing, a signal write process and a mobility correction process. Then, the threshold-voltage correction process is carried out a plurality of times distributed among the 1H horizontal scan periods each leading ahead the specific 1H scan period and the specific 1H scan period itself. It is to be noted, however, that the scope of the present invention is by no means limited to the embodiment. For example, it is also possible to apply the present invention to a configuration in which the threshold-voltage correction process is carried out only once in the specific 1H scan period allocated also to a signal write process and a mobility correction process.

Write Scan Period

The following description explains a typical concrete circuit configuration of the write scan circuit 40 for outputting the write pulses WS1 and WS2 each used in an operation carried out to store the reference electric potential Vofs into the storage capacitor 24 in the distributed Vth correction processing and the write pulse WS0 used for storing the video-signal voltage Vsig into the storage capacitor 24 in a signal write process with the timings shown in the timing/waveform diagram shown in FIG. 11.

First Write/Scan-Circuit Embodiment

Figure 13:
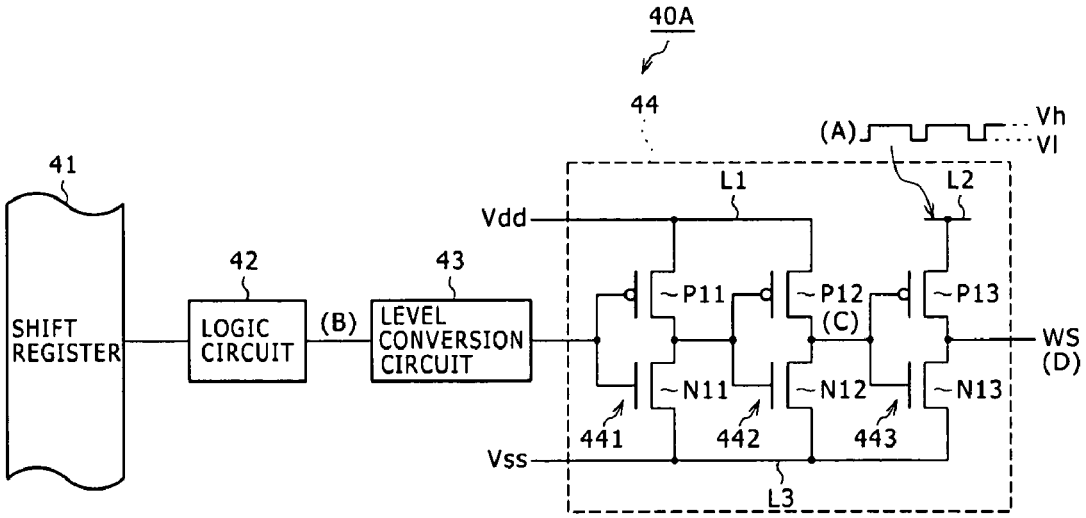
FIG. 13 is a circuit diagram showing a typical circuit configuration of a write scan circuit according to a first write/scan-circuit embodiment.

FIG. 13 is a circuit diagram showing a typical circuit configuration of a write scan circuit 40A according to a first write/scan-circuit embodiment. In order to make the circuit diagram simple, the figure shows only a circuit portion for generating a write pulse WS for a certain pixel row. It is to be noted, however, that each of circuit portions for generating write pulses WS for pixel rows other than the certain pixel row has the same configuration as the circuit portion shown in the circuit diagram of FIG. 13.

The write scan circuit 40A according to the first write/scan-circuit embodiment has a configuration including a shift register 41, a logic circuit 42, a level conversion circuit 43 and an output circuit 44.

In the write scan circuit 40A, a shift pulse output by a shift stage included in the shift register 41 as a shift stage corresponding to the certain pixel row is supplied to the logic circuit 42 which converts the shift pulse into a scan pulse with a timing determined in advance. The shift stage is one of unit circuits linked to each other in cascade connection to form the shift register 41. The logic circuit 42 supplies the scan pulse to the level conversion circuit 43 which converts the level of the scan pulse from a logic level of typically about 3.3 V into a high level of typically about 15 V. The level conversion circuit 43 outputs the pulse with the high level to pixel circuits on the certain pixel row as a write pulse WS by way of the output circuit 44 and a scan line 31 corresponding to the row.

The output circuit 44 typically employs first, second and third buffers 441, 442 and 443 provided at three stages respectively. The output circuit 44 is configured so that the first and second buffers 441 and 442 provided at the first and second stages respectively have a first power-supply line L1 which is separated from a second power-supply line L2 of the third buffer 443 provided at the last stage.

The first buffer 441 has a configuration of a CMOS inverter employing a first P-channel MOS transistor P11 and a first N-channel MOS transistor N11 with the gate electrode thereof connected to the gate electrode of the first P-channel MOS transistor P11 and the drain electrode thereof connected to the drain electrode of the first P-channel MOS transistor P11. The source electrode of the first P-channel MOS transistor P11 is connected to the first power-supply line L1 of a power-supply voltage Vdd whereas the source electrode of the first N-channel MOS transistor N11 is connected to the third power-supply line L3 of a power-supply voltage Vss. The gate electrodes of the second P-channel MOS transistor P12 and the second N-channel MOS transistor N12 are connected to the output terminal of the level conversion circuit 43.

By the same token, the second buffer 442 has a configuration of a CMOS inverter employing a second P-channel MOS transistor P12 and a second N-channel MOS transistor N12 with the gate electrode thereof connected to the gate electrode of the second P-channel MOS transistor P12 and the drain electrode thereof connected to the drain electrode of the second P-channel MOS transistor P12. The source electrode of the second P-channel MOS transistor P12 is connected to the first power-supply line L1 whereas the source electrode of the second N-channel MOS transistor N12 is connected to the third power-supply line L3. The gate electrodes of the second P-channel MOS transistor P12 and the second N-channel MOS transistor N12 are connected to the drain electrodes of the first P-channel MOS transistor P11 and the first N-channel MOS transistor N11.

In the same way, the third buffer 443 has a configuration of a CMOS inverter employing a third P-channel MOS transistor P13 and a third N-channel MOS transistor N13 with the gate electrode thereof connected to the gate electrode of the third P-channel MOS transistor P13 and the drain electrode thereof connected to the drain electrode of the third P-channel MOS transistor P13. The source electrode of the third P-channel MOS transistor P13 is connected to the second power-supply line L2 whereas the source electrode of the third N-channel MOS transistor N13 is connected to the third power-supply line L3. The gate electrodes of the third P-channel MOS transistor P13 and the third N-channel MOS transistor N13 are connected to the drain electrodes of the second P-channel MOS transistor P12 and the second N-channel MOS transistor N12.

Figures 14A, 14B, 14C, 14D:
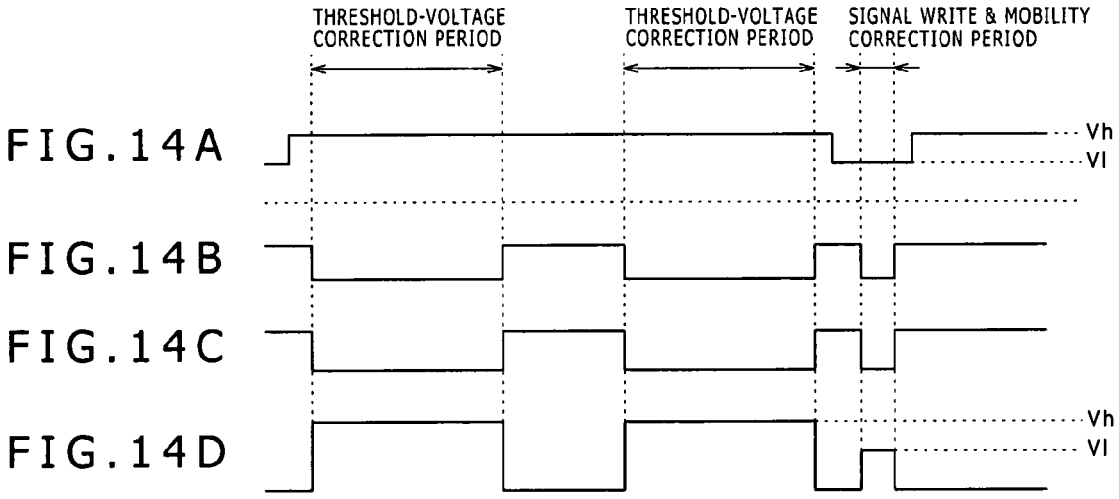
FIGS. 14A to 14D are a plurality of timing/waveform diagrams for signals generated in the write scan circuit shown in the circuit diagram of FIG. 13 as the write scan circuit according to the first write/scan-circuit embodiment.

A low voltage Vl of typically about 15 V is asserted on the second power-supply line L2 as a power-supply voltage during a specific period allocated to a signal write process (and a mobility correction process) and periods sandwiching the specific period as shown in a timing/waveform diagram of FIG. 14A. During periods other than the specific period and the sandwiching periods, on the other hand, a high voltage Vh of typically about 25 V is asserted on the second power-supply line L2 as a power-supply voltage as shown in the same timing/waveform diagram.

FIGS. 14A to 14D are a plurality of timing/waveform diagrams for signals generated in the write scan circuit 40A. To be more specific, FIG. 14A is a timing/waveform diagram for the power-supply voltage asserted on the second power-supply line L2. FIG. 14B is a timing/waveform diagram for the scan pulses output by the logic circuit 42. FIG. 14C is a timing/waveform diagram for pulses supplied to the third buffer 443. FIG. 14D is a timing/waveform diagram for the write pulses WS output by the output circuit 44.

As described above, the output circuit 44 employed in the write scan circuit 40A is configured to include the first and second buffers 441 and 442 provided at the first and second stages respectively as buffers having the first power-supply line L1 which is separated from the second power-supply line L2 connected to the third buffer 443 also included in the output circuit 44 at the last stage. Then, by properly selecting the high voltage Vh or the low voltage Vl as a power-supply voltage to be asserted on the second power-supply line L2, the power-supply voltage asserted on the second power-supply line L2 can be switched from the high voltage Vh to the low voltage Vl and vice versa in an extremely simple configuration in order to generate write pulses WS for the reference electric potential Vofs and the video-signal voltage Vsig.

Second Write/Scan-Circuit Embodiment

Figure 15:
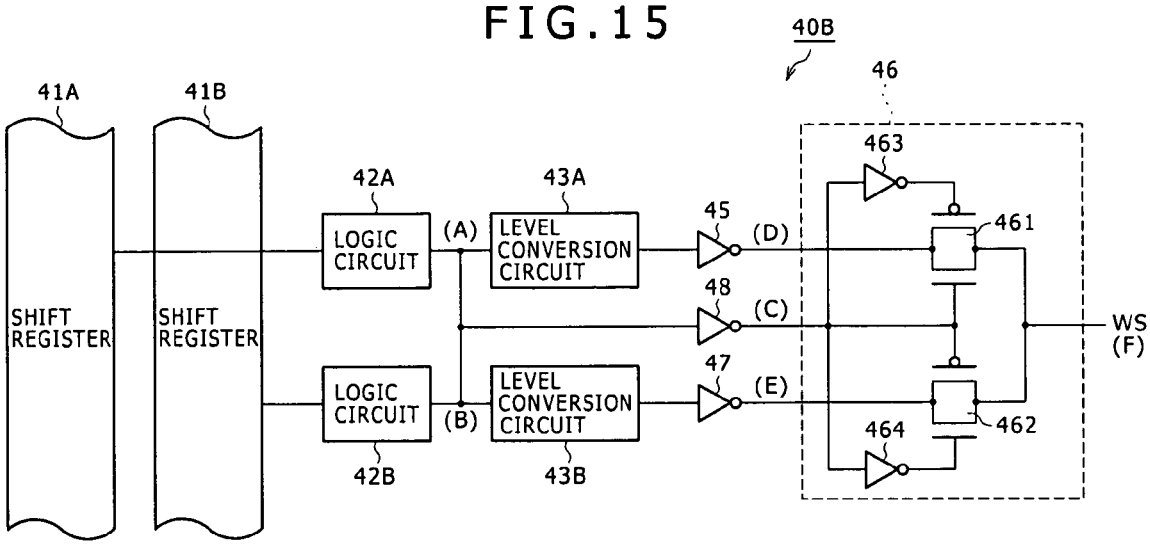
FIG. 15 is a circuit diagram showing a typical circuit configuration of a write scan circuit according to a second write/scan-circuit embodiment.

FIG. 15 is a circuit diagram showing a typical circuit configuration of a write scan circuit 40B according to a second write/scan-circuit embodiment. In order to make the circuit diagram simple, the figure shows only a circuit portion for generating a write pulse WS for a certain pixel row. It is to be noted, however, that each of circuit portions for generating write pulses WS for pixel rows other than the certain pixel row has the same configuration as the circuit portion shown in the circuit diagram of FIG. 15.

The write scan circuit 40B according to the second write/scan-circuit embodiment includes a first circuit portion for generating write pulses WS each having a first waveform height as write pulses WS each used in a signal write process carried out to store the video-signal voltage Vsig into the storage capacitor 24 and a second circuit portion for generating write pulses WS each having a second waveform height as write pulses WS each used in a process carried out to store the reference electric potential Vofs into the storage capacitor 24. The write scan circuit 40B is configured to be capable of selectively driving the first circuit portion to generate write pulses WS each having the first waveform height as write pulses WS each used in the signal write process carried out to store the video-signal voltage Vsig into the storage capacitor 24 or the second circuit portion to generate write pulses WS each having the second waveform height as write pulses WS each used in the process carried out to store the reference electric potential Vofs into the storage capacitor 24.

To put it concretely, the write scan circuit 40B is configured to include two systems each employing a shift register 41, a logic circuit 42 and a level conversion circuit 43. That is to say, the first system corresponding to the first circuit portion employs a first shift register 41A, a first logic circuit 42A and a first level conversion circuit 43A which are used for generating write pulses WS having the first waveform height whereas the second system corresponding to the second circuit portion employs a second shift register 41B, a second logic circuit 42B and a second level conversion circuit 43B which are used for generating write pulses WS having the second waveform height.

The first shift register 41A is a component for generating a shift pulse from a shift stage corresponding to the certain pixel row with a timing coinciding with a signal write process to store the video-signal voltage Vsig into the storage capacitor 24. The shift pulse output by the shift stage is supplied to the first logic circuit 42A which converts the shift pulse into a scan pulse with the timing coinciding with the signal write process to store the video-signal voltage Vsig into the storage capacitor 24. The first logic circuit 42A supplies the scan pulse to the first level conversion circuit 43A which converts the level of the scan pulse from a logic level of typically about 3.3 V to a small-amplitude level of typically about 15 V. The first level conversion circuit 43A outputs the scan pulse with the small-amplitude level to a multiplexer 46 by way of a first buffer 45.

By the same token, the second shift register 41B is a component for generating a shift pulse from a shift stage corresponding to the certain pixel row with a timing coinciding with a process to store the reference electric potential Vofs into the storage capacitor 24. The shift pulse output by the shift stage is supplied to the second logic circuit 42B which converts the shift pulse into a scan pulse with the timing coinciding with the process to store the reference electric potential Vofs into the storage capacitor 24. The second logic circuit 42B supplies the scan pulse to the second level conversion circuit 43B which converts the level of the scan pulse from a logic level of typically about 3.3 V into a large-amplitude level of typically about 25 V. The second level conversion circuit 43B outputs the scan pulse with the large-amplitude level to the multiplexer 46 by way of a second buffer 47.

The multiplexer 46 has a configuration including two analog switches, that is, first and second analog switches 461 and 462 and two inverters, that is first and second inverters 463 and 464. Each of the first and second analog switches 461 and 462 is typically a CMOS switch. Each of the first and second inverters 463 and 464 is a component for inverting the polarity of switch control pulses supplied thereto by the logic circuits 42A and 42B by way a third buffer 48. The analog switches 461 and 462 select an output pulse received from the first buffer 45 or an output pulse received from the second buffer 47 and supply the selected pulse to pixel circuits on the certain row as a write pulse WS.

Figures 16A, 16B, 16C, 16D, 16E, 16F:
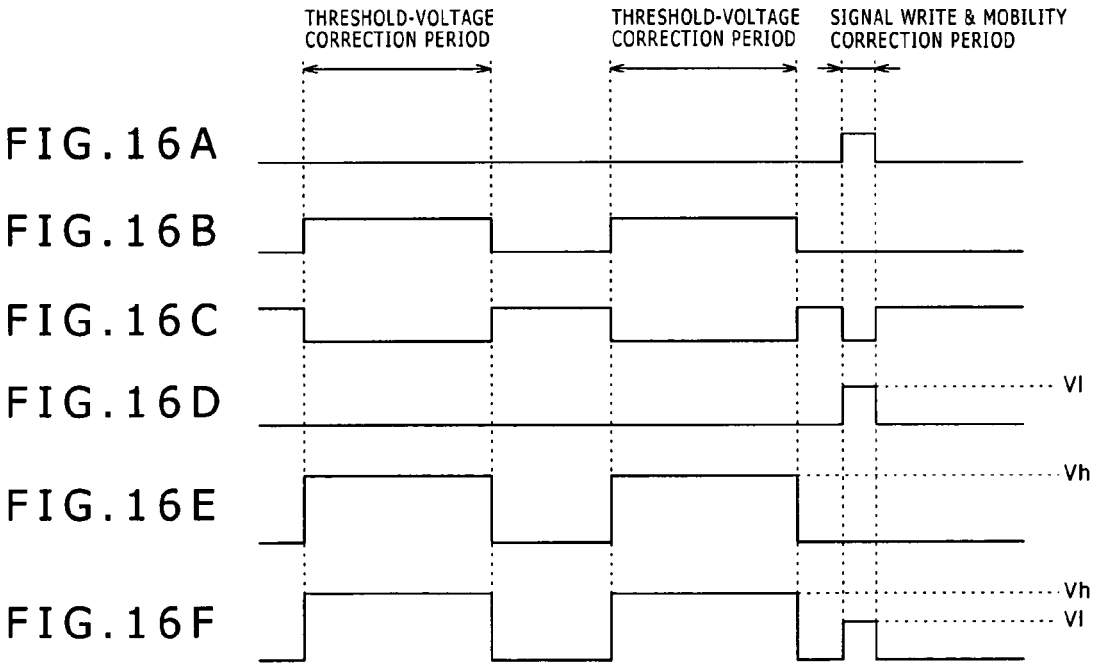
FIGS. 16A to 16F are a plurality of timing/waveform diagrams for signals generated in the write scan circuit shown in the circuit diagram of FIG. 15 as the write scan circuit according to the first write/scan-circuit embodiment.

FIGS. 16A to 16F are a plurality of timing/waveform diagrams of signals generated in the write scan circuit 40B shown in the circuit diagram of FIG. 15. To be more specific, FIG. 16A is a timing/waveform diagram of a scan pulse output by the first logic circuit 42A whereas FIG. 16B is a timing/waveform diagram of scan pulses output by the second logic circuit 42B. FIG. 16C is a timing/waveform diagram of output pulses generated by the third buffer 48. FIG. 16D is a timing/waveform diagram of an output pulse generated by the first buffer 45 whereas FIG. 16E is a timing/waveform diagram of output pulses generated by the second buffer 47. FIG. 16F is a timing/waveform diagram of write pulses WS output by the multiplexer 46.

As described above, the write scan circuit 40B according to the second write/scan-circuit embodiment includes a first circuit portion for generating write pulses WS each having a first waveform height for a signal write process carried out to store the video-signal voltage Vsig into the storage capacitor 24 and a second circuit portion for generating write pulses WS each having a second waveform height for a process carried out to store the reference electric potential Vofs into the storage capacitor 24. In addition, the write scan circuit 40B is configured to be capable of selectively driving the first circuit portion to generate write pulses WS each having the first waveform height for the signal write process carried out to store the video-signal voltage Vsig into the storage capacitor 24 or the second circuit portion to generate write pulses WS each having the second waveform height for the process carried out to store the reference electric potential Vofs into the storage capacitor 24. Thus, the write scan circuit 40B is capable of generating a write pulse WS used in a process carried out to store the reference electric potential Vofs into the storage capacitor 24 as a write pulse WS having the second waveform height different from the first waveform height of a write pulse WS generated by the write scan circuit 40B as a write pulse WS used in a signal write process carried out to store the video-signal voltage Vsig into the storage capacitor 24.

The above description explains two write/scan-circuit embodiments each implementing a typical concrete circuit configuration of the write scan circuit 40. However, typical concrete circuit configurations of the write scan circuit 40 are by no means limited to these embodiments.

Modified Versions

Even though the embodiment described above is applied to an active-matrix organic EL display apparatus 10 employing pixel circuits 20 each having an organic EL device as the electro optical device, the scope of the present invention is by no means limited to the embodiment. To put it concretely, the present invention can be applied to general display apparatus each employing pixel circuits each having a current-driven electro optical device functioning as a light emitting device for emitting light with a luminance according to the magnitude of a current flowing through the device. Examples of such a current-driven electro optical device are the organic EL device, an LED (Light Emitting Diode) device and a semiconductor laser device.

In addition, it should be understood by those skilled in the art that a variety of modifications, combinations, sub-combinations and alterations may occur, depending on design requirements and other factors as far as they are within the scope of the appended claims or the equivalents thereof.

APPLICATION EXAMPLES

The display apparatus according to the present invention described above is typically employed in a variety of electronic instruments shown in diagrams of FIGS. 17 to 21G as instruments used in all fields. Examples of the electronic instruments are a digital camera, a laptop personal computer, a portable terminal such as a cellular phone and a video camera. In each of these electronic instruments, the display apparatus is used for displaying a video signal supplied thereto or generated therein as an image or a video.

As described above, the display apparatus according to the embodiments of the present invention can be used as a display unit of electronic instruments in all fields. Thus, as is obvious from the description given earlier as description of the embodiment, the display apparatus according to the present invention is capable of normally carrying out a signal write process to store a video-signal voltage Vsig into the storage capacitor 24 as well as a mobility correction process. As a result, the display apparatus is capable of displaying an image of a high definition and a high quality in a variety of electronic instruments.

It is to be noted that the display apparatus according to the present invention include an apparatus constructed into a modular shape with a sealed configuration. For example, the display apparatus according to the present invention is designed into configuration in which the pixel array section 30 is implemented as a display module created by attaching the module to a facing unit made of a material such as transparent glass. On the transparent facing unit, components such as a color filter and a protection film can be created in addition to a shielding film described earlier. It is to be noted that the display module serving as the pixel array section 30 may include components such as a circuit for supplying a signal received from an external source to the pixel array section 30, a circuit for supplying a signal received from the pixel array section 30 to an external destination and an FPC (Flexible Print Circuit).

The following description explains concrete implementations of the electronic instrument to which the present invention is applied.

Figure 17:
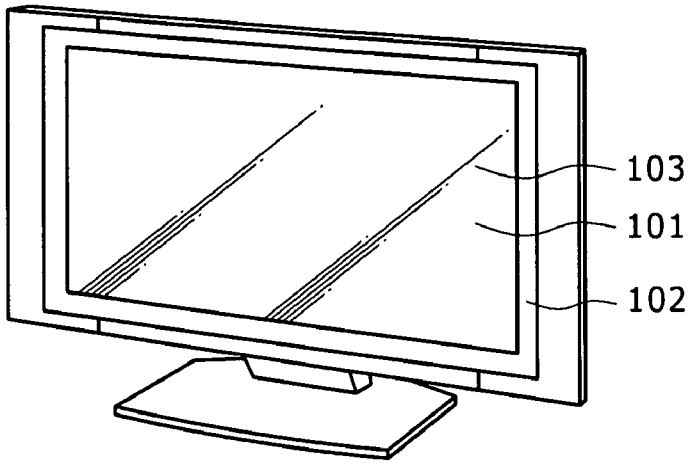
FIG. 17 is a diagram showing a squint view of the external appearance of a TV set to which an embodiment of the present invention is applied.

FIG. 17 is a diagram showing a squint view of the external appearance of a TV set to which an embodiment of the present invention is applied. The TV set serving as a typical implementation of the electronic instrument according to the application example employs a front panel 102 and a video display screen section 101 which is typically a filter glass plate 103. The TV set is constructed by employing the display apparatus provided by the present invention in the TV set as the video display screen section 101.

Figure 18A:
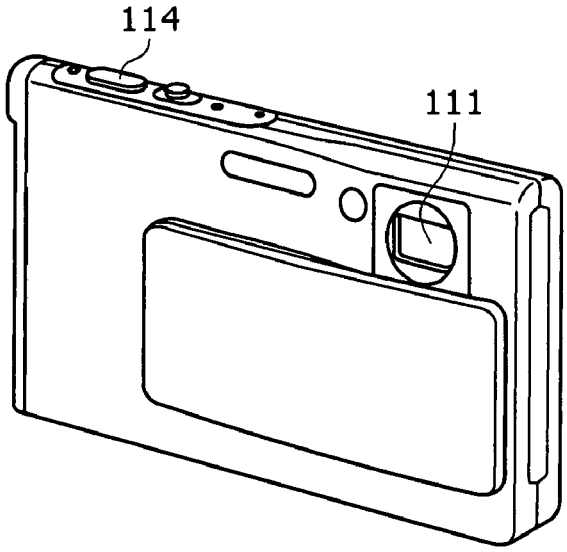
FIGS. 18A and 18B are a plurality of diagrams each showing a squint view of the external appearance of a digital camera to which an embodiment of the present invention is applied.
Figure 18B:
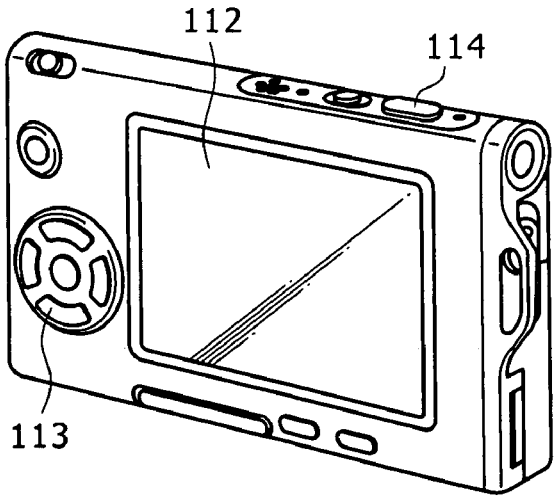

FIGS. 18A and 18B are a plurality of diagrams each showing a squint view of the external appearance of a digital camera to which an embodiment of the present invention is applied. To be more specific, FIG. 18A is a diagram showing a squint view of the external appearance of the digital camera seen from a position on the front side of the digital camera whereas FIG. 18B is a diagram showing a squint view of the external appearance of the digital camera seen from a position on the rear side of the digital camera. The digital camera serving as a typical implementation of the electronic instrument according to the application example employs a light emitting section 111 for generating a flash, a display section 112, a menu switch 113 and a shutter button 114. The digital camera is constructed by employing the display apparatus provided by the present invention in the digital camera as the display section 112.

Figure 19:
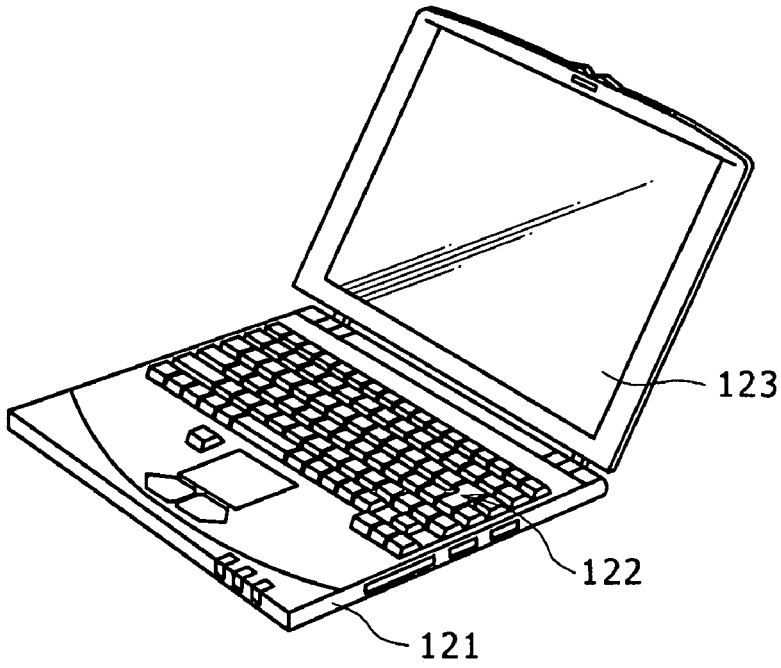
FIG. 19 is a diagram showing a squint view of the external appearance of a laptop personal computer to which an embodiment of the present invention is applied.

FIG. 19 is a diagram showing a squint view of the external appearance of a laptop personal computer to which an embodiment of the present invention is applied. The laptop personal computer serving as a typical implementation of the electronic instrument according to the application example employs a main body 121 including a keyboard 122 to be operated by the user for entering characters and a display section 123 for displaying an image. The laptop personal computer is constructed by employing the display apparatus provided by the present invention in the personal computer as the display section 123.

Figure 20:
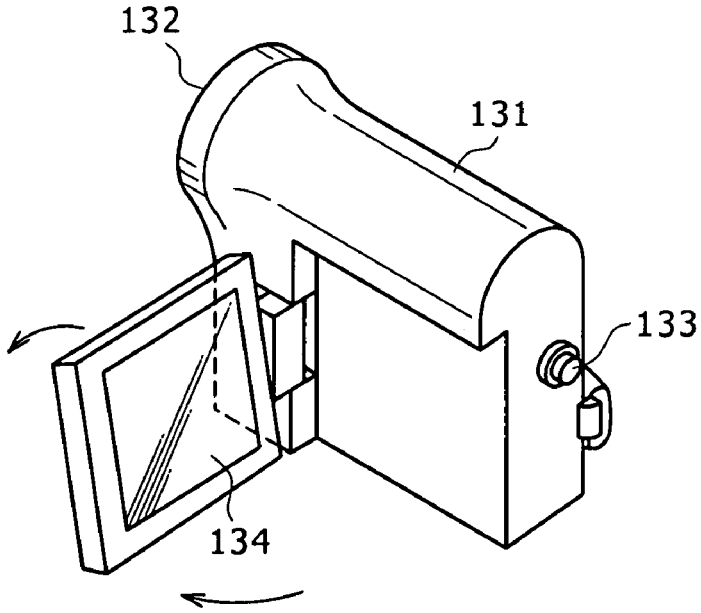
FIG. 20 is a diagram showing a squint view of the external appearance of a video camera to which an embodiment of the present invention is applied.

FIG. 20 is a diagram showing a squint view of the external appearance of a video camera to which an embodiment of the present invention is applied. The video camera serving as a typical implementation of the electronic instrument according to the application example employs a main body 131, a photographing lens 132, a start/stop switch 133 and a display section 134. Provided on the front face of the video camera, the photographing lens 132 oriented forward is a lens for taking a picture of a subject of photographing. The start/stop switch 133 is a switch to be operated by the user to start or stop a photographing operation. The video camera is constructed by employing the display apparatus provided by the present invention in the video camera as the display section 134.

Figures 21A, 21B:
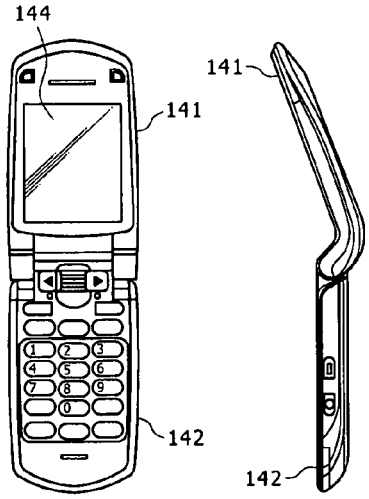
FIGS. 21A to 21G are a plurality of diagrams each showing the external appearance of a portable terminal such as a cellular phone to which an embodiment of the present invention is applied.
Figure 21F:
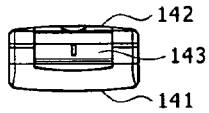
Figures 21C, 21D, 21E:
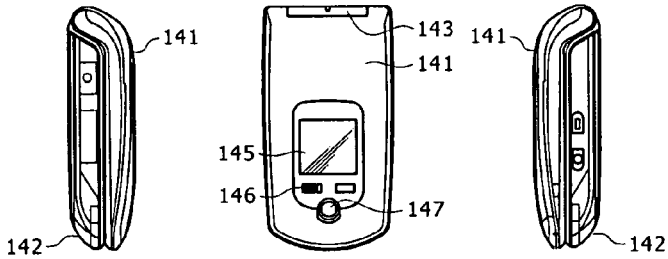
Figure 21G:
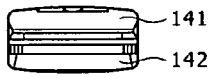

FIGS. 21A to 21G are a plurality of diagrams each showing the external appearance of a portable terminal such as a cellular phone to which an embodiment of the present invention is applied. To be more specific, FIG. 21A is a diagram showing the front view of the cellular phone in a state of being already opened. FIG. 21B is a diagram showing a side of the cellular phone in a state of being already opened. FIG. 21C is a diagram showing the front view of the cellular phone in a state of being already closed. FIG. 21D is a diagram showing the left side of the cellular phone in a state of being already closed. FIG. 21E is a diagram showing the right side of the cellular phone in a state of being already closed. FIG. 21F is a diagram showing the top view of the cellular phone in a state of being already closed. FIG. 21G is a diagram showing the bottom view of the cellular phone in a state of being already closed. The cellular phone serving as a typical implementation of the electronic instrument according to the application example employs an upper case 141, a lower case 142, a link section 143 which is a hinge, a display section 144, a display sub-section 145, a picture light 146 and a camera 147. The cellular phone is constructed by employing the display apparatus provided by the present invention in the cellular phone as the display section and the display sub-section 145.

What is claimed is:

1. A display apparatus comprising:

a pixel array section including pixel circuits laid out to form a matrix as pixel circuits each having an electro optical device, a signal writing transistor having the gate electrode thereof connected to a scan line and a particular one of electrodes thereof connected to a signal line, a device driving transistor having the gate electrode thereof connected to the other electrode of said signal writing transistor, a specific one of electrodes thereof connected to a power-supply line and the other electrode thereof connected to the anode electrode of said electro optical device, and a storage capacitor having one of electrodes thereof connected to said gate electrode of said device driving transistor as well as said other electrode of said signal writing transistor and the other electrode thereof connected to said other electrode of said device driving transistor as well as said anode electrode of said electro optical device;

a power-supply scan circuit for selectively supplying a first power-supply electric potential or a second power-supply electric potential lower than said first power-supply electric potential to said specific electrode of said device driving transistor through said power-supply line;

a signal outputting circuit for selectively outputting a video signal or a reference electric potential to said particular electrode of said signal writing transistor through said signal line; and a write scan circuit for supplying a write pulse to said gate electrode of said signal writing transistor through said scan line when said signal outputting circuit is outputting said video signal or said reference electric potential to said particular electrode of said signal writing transistor through said signal line, wherein after an electric potential appearing on said gate electrode of said device driving transistor has been initialized at an initialization electric potential equal to said reference electric potential in an operation carried out by said signal writing transistor to store said reference electric potential into said storage capacitor connected to said gate electrode of said device driving transistor, a threshold-voltage correction process is carried out to change an electric potential appearing on said other electrode of said device driving transistor toward an electric-potential level obtained by subtracting the threshold voltage of said device driving transistor from said reference electric potential which is said initialization electric potential of said gate electrode of said device driving transistor, and said write scan circuit supplies a write pulse to said gate electrode of said signal writing transistor when said signal outputting circuit is outputting said reference electric potential to said particular electrode of said signal writing transistor as a write pulse having a waveform height greater than the waveform height of a write pulse supplied by said write scan circuit to said gate electrode of said signal writing transistor when said signal outputting circuit is outputting said video signal to said particular electrode of said signal writing transistor.

2. The display apparatus according to claim 1 wherein:

prior to a 1H horizontal scan period in which a signal write process is carried out by said signal writing transistor to store said video signal output by said signal outputting circuit to said particular electrode of said signal writing transistor into said storage capacitor connected to said gate electrode of said device driving transistor, said threshold-voltage correction process is carried out a plurality of times distributed among the same plurality of 1H horizontal scan periods; and said write scan circuit sets the waveform height of write pulses supplied to said gate electrode of said signal writing transistor as a write pulse for said reference electric potential output to said particular electrode of said signal writing transistor during said 1H horizontal scan periods of said threshold-voltage correction process at a value greater than the waveform height of a write pulse supplied to said gate electrode of said signal writing transistor as a write pulse for said video signal output to said particular electrode of said signal writing transistor in said signal write process.

3. The display apparatus according to claim 2 wherein said write scan circuit sets the waveform height of write pulses each supplied to said gate electrode of said signal writing transistor as a write pulse for said reference electric potential output to said particular electrode of said signal writing transistor during said 1H horizontal scan periods of said threshold-voltage correction process at a value gradually decreasing toward the waveform height of a write pulse supplied to said gate electrode of said signal writing transistor as a write pulse for said video signal output to said particular electrode of said signal writing transistor in said signal write process in such a way that, the later the 1H horizontal scan period, the smaller the waveform height of said write pulses each supplied for said reference electric potential.

4. The display apparatus according to claim 1 wherein, prior to a 1H horizontal scan period in which a signal write process is carried out by said signal writing transistor to store a video signal output by said signal outputting circuit to said particular electrode of said signal writing transistor into said storage capacitor connected to said gate electrode of said device driving transistor, said threshold-voltage correction process is carried out a plurality of times distributed among the same plurality of 1H horizontal scan periods in such a way that:

said write scan circuit sets the waveform height of a write pulse supplied to said gate electrode of said signal writing transistor as a write pulse for said reference electric potential output to said particular electrode of said signal writing transistor during the last one of said 1H horizontal scan periods of said threshold-voltage correction process at a value about equal to the waveform height of a write pulse supplied to said gate electrode of said signal writing transistor as a write pulse for said video signal output to said particular electrode of said signal writing transistor in said signal write process; and said write scan circuit sets the waveform height of write pulses each supplied to said gate electrode of said signal writing transistor as a write pulse for said reference electric potential output to said particular electrode of said signal writing transistor during said 1H horizontal scan periods of said threshold-voltage correction process except said last 1H horizontal scan period at a value greater than the waveform height of a write pulse supplied to said gate electrode of said signal writing transistor as a write pulse for said video signal output to said particular electrode of said signal writing transistor in said signal write process.

5. The display apparatus according to claim 1 wherein a mobility correction process to negatively feed the magnitude of a current flowing through said device driving transistor back to said gate electrode of said device driving transistor is carried out concurrently with a signal write process carried out by said signal writing transistor to store a video signal output by said signal outputting circuit to said particular electrode of said signal writing transistor into said storage capacitor connected to said gate electrode of said device driving transistor.

6. The display apparatus according to claim 1 wherein:

said write scan circuit includes a front-stage buffer and a last-stage buffer having a power-supply line different from the power-supply line of said front-stage buffer; and by changing a power-supply voltage asserted on said power-supply line of said last-stage buffer, said write scan circuit is capable of generating a write pulse for a signal write process carried out to store a video signal into said storage capacitor connected to said gate electrode of said device driving transistor as a write pulse having a waveform height different from the waveform height of a write pulse for said threshold-voltage correction process carried out to store said reference electric potential into said storage capacitor.

7. The display apparatus according to claim 1 wherein said write scan circuit:

includes a circuit for generating a write pulse having a first waveform height and a circuit for generating a write pulse having a second waveform height; and selectively outputs said write pulse having said first waveform height for a signal write process carried out to store a video signal into said storage capacitor connected to said gate electrode of said device driving transistor or said write pulse having said second waveform height for said threshold-voltage correction process carried out to store said reference electric potential into said storage capacitor.

8. A driving method for driving a display apparatus comprising a pixel array section including pixel circuits laid out to form a matrix as pixel circuits each having an electro optical device, a signal writing transistor having the gate electrode thereof connected to a scan line and a particular one of electrodes thereof connected to a signal line, a device driving transistor having the gate electrode thereof connected to the other electrode of said signal writing transistor, a specific one of electrodes thereof connected to a power-supply line and the other electrode thereof connected to the anode electrode of said electro optical device, and a storage capacitor having one of electrodes thereof connected to said gate electrode of said device driving transistor as well as said other electrode of said signal writing transistor and the other electrode thereof connected to said other electrode of said device driving transistor as well as said anode electrode of said electro optical device, a power-supply scan circuit for selectively supplying a first power-supply electric potential or a second power-supply electric potential lower than said first power-supply electric potential to said specific electrode of said device driving transistor through said power-supply line, and a signal outputting circuit for selectively outputting a video signal or a reference electric potential to said particular electrode of said signal writing transistor through said signal line, said driving method comprising the steps of:

supplying a write pulse to said gate electrode of said signal writing transistor through said scan line when said signal outputting circuit is outputting said video signal or said reference electric potential to said particular electrode of said signal writing transistor through said signal line;

carrying out a threshold-voltage correction process, after an electric potential appearing on said gate electrode of said device driving transistor has been initialized at an initialization electric potential equal to said reference electric potential in an operation carried out by said signal writing transistor to store said reference electric potential into said storage capacitor connected to said gate electrode of said device driving transistor, to change an electric potential appearing on said other electrode of said device driving transistor toward an electric-potential level obtained by subtracting the threshold voltage of said device driving transistor from said reference electric potential which is said initialization electric potential of said gate electrode of said device driving transistor; and supplying a write pulse to said gate electrode of said signal writing transistor when said signal outputting circuit is outputting said reference electric potential to said particular electrode of said signal writing transistor as a write pulse having a waveform height greater than the waveform height of a write pulse supplied by said write scan circuit to said gate electrode of said signal writing transistor when said signal outputting circuit is outputting said video signal to said particular electrode of said signal writing transistor.

9. An electronic instrument comprising:

a pixel array section including pixel circuits laid out to form a matrix as pixel circuits each having an electro optical device, a signal writing transistor having the gate electrode thereof connected to a scan line and a particular one of electrodes thereof connected to a signal line, a device driving transistor having the gate electrode thereof connected to the other electrode of said signal writing transistor, a specific one of electrodes thereof connected to a power-supply line and the other electrode thereof connected to the anode electrode of said electro optical device, and a storage capacitor having one of electrodes thereof connected to said gate electrode of said device driving transistor as well as said other electrode of said signal writing transistor and the other electrode thereof connected to said other electrode of said device driving transistor as well as said anode electrode of said electro optical device;

a power-supply scan circuit for selectively supplying a first power-supply electric potential or a second power-supply electric potential lower than said first power-supply electric potential to said specific electrode of said device driving transistor through said power-supply line;

a signal outputting circuit for selectively outputting a video signal or a reference electric potential to said particular electrode of said signal writing transistor through said signal line; and a write scan circuit for supplying a write pulse to said gate electrode of said signal writing transistor through said scan line when said signal outputting circuit is outputting said video signal or said reference electric potential to said particular electrode of said signal writing transistor through said signal line, wherein after an electric potential appearing on said gate electrode of said device driving transistor has been initialized at an initialization electric potential equal to said reference electric potential in an operation carried out by said signal writing transistor to store said reference electric potential into said storage capacitor connected to said gate electrode of said device driving transistor, a threshold-voltage correction process is carried out to change an electric potential appearing on said other electrode of said device driving transistor toward an electric-potential level obtained by subtracting the threshold voltage of said device driving transistor from said reference electric potential which is said initialization electric potential of said gate electrode of said device driving transistor, and said write scan circuit supplies a write pulse to said gate electrode of said signal writing transistor when said signal outputting circuit is outputting said reference electric potential to said particular electrode of said signal writing transistor as a write pulse having a waveform height greater than the waveform height of a write pulse supplied by said write scan circuit to said gate electrode of said signal writing transistor when said signal outputting circuit is outputting said video signal to said particular electrode of said signal writing transistor.

* * * * *